US010577887B2

(12) United States Patent
Dockweiler

(10) Patent No.: US 10,577,887 B2
(45) Date of Patent: Mar. 3, 2020

(54) RESETTABLE PRE-SET MECHANISM FOR DOWNHOLE TOOLS

(71) Applicant: HALLIBURTON ENERGY SERVICES, INC., Houston, TX (US)

(72) Inventor: David Allen Dockweiler, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 179 days.

(21) Appl. No.: 15/743,986

(22) PCT Filed: Aug. 27, 2015

(86) PCT No.: PCT/US2015/047249
§ 371 (c)(1),
(2) Date: Jan. 11, 2018

(87) PCT Pub. No.: WO2017/034585
PCT Pub. Date: Mar. 2, 2017

(65) Prior Publication Data

US 2018/0209242 A1 Jul. 26, 2018

(51) Int. Cl.
*E21B 33/12* (2006.01)
*E21B 33/129* (2006.01)

(52) U.S. Cl.
CPC ..... *E21B 33/1208* (2013.01); *E21B 33/1292* (2013.01)

(58) Field of Classification Search
CPC .. E21B 33/1208; E21B 33/128; E21B 33/129; E21B 33/1291; E21B 33/1292; E21B 33/1293
See application file for complete search history.

(56) References Cited

U.S. PATENT DOCUMENTS 3,094,169 A * 6/1963 Conrad ..... E21B 33/1292 166/134
3,311,171 A * 3/1967 Castro ..... E21B 33/129 166/196

(Continued)

OTHER PUBLICATIONS

International Search Report and Written Opinion dated May 17, 2016, in PCT Application No. PCT/US2015/047247.

(Continued)

*Primary Examiner* — Blake E Michener
(74) *Attorney, Agent, or Firm* — McAfee & Taft

(57) ABSTRACT

A downhole tool for use in a subterranean well having a casing therein. The downhole tool has a mandrel, a wedge, a slip bank and a pre-set mechanism. The wedge is disposed about the mandrel and in sliding relationship with the mandrel such that the wedge can slide between an unset position and a set position. The slip bank is associated with the wedge such that, when the slip wedge is in the unset position, the slip bank is in a radially inward position and does not engage the casing, and when the slip wedge is in the set position, the slip bank is in a radially outward position and engages the casing. The pre-set mechanism has a first detent ring located between the first wedge and the mandrel and positioned at least partially in a groove in the mandrel. The detent ring prevents the wedge from moving from the unset position to the set position until a load on the mandrel exceeds a predetermined force.

20 Claims, 13 Drawing Sheets

(56) References Cited

U.S. PATENT DOCUMENTS

| | | | | |
|---|---|---|---|---|
| 3,343,607 | A * | 9/1967 | Current | E21B 33/1216 166/182 |
| 3,460,617 | A * | 8/1969 | Brown | E21B 23/04 166/124 |
| 4,359,090 | A | 11/1982 | Luke | |
| 4,441,553 | A * | 4/1984 | Setterberg, Jr. | E21B 33/1293 166/138 |
| 4,671,354 | A | 6/1987 | Henderson et al. | |
| 4,898,245 | A | 2/1990 | Braddick | |
| 5,193,620 | A * | 3/1993 | Braddick | E21B 7/061 166/117.6 |
| 5,350,013 | A | 9/1994 | Jani et al. | |
| 5,692,564 | A | 12/1997 | Brooks | |
| 5,701,959 | A | 12/1997 | Hushbeck et al. | |
| 6,378,606 | B1 | 4/2002 | Swor et al. | |
| 6,481,497 | B2 | 11/2002 | Swor et al. | |
| 7,198,110 | B2 | 4/2007 | Kilgore et al. | |
| 7,726,406 | B2 | 6/2010 | Xu | |
| 7,806,189 | B2 | 10/2010 | Frazier | |
| 8,267,174 | B2 | 9/2012 | Rogers et al. | |
| 8,997,882 | B2 | 4/2015 | Turley et al. | |
| 2002/0088616 | A1 | 7/2002 | Swor et al. | |
| 2006/0272828 | A1 | 12/2006 | Manson | |
| 2010/0243232 | A1 | 9/2010 | Zimmerman et al. | |
| 2012/0160522 | A1 | 6/2012 | Burgos | |
| 2012/0186830 | A1 * | 7/2012 | Henckel | E21B 33/129 166/387 |

OTHER PUBLICATIONS

International Search Report and Written Opinion dated May 17, 2016, in PCT Application No. PCT/US2015/047249.

Search Report and Opinion dated Apr. 11, 2018, issued in Danish Patent Application PA 2017 00707.

* cited by examiner

RESETTABLE PRE-SET MECHANISM FOR DOWNHOLE TOOLS

FIELD

The present disclosure relates generally to equipment utilized in operations performed, in conjunction with subterranean wells and, in some embodiments described herein, more particularly to a multiple slip retrievable packer or bridge plug.

BACKGROUND

In the course of treating and preparing subterranean wells for production, a well packer or bridge plug is run into the well on a work string or a production tubing. The purpose of the packer or bridge plug is to provide isolation between zones of the wellbore. For example, the packer or bridge plug can be used to seal the annulus between the outside of the production tubing and the inside of the well casing to block movement of fluids through the annulus past the packer or bridge plug location. The packer or bridge plug is typically provided with anchor slips having opposed camming surfaces which cooperate with complementary opposed wedging surfaces; whereby the anchor slips are radially extendible into gripping engagement against the well casing bore in response to relative axial movement of the wedging surfaces.

The packer or bridge plug also carries annular seal elements which are expandable radially into sealing engagement against the bore of the well casing. Longitudinal movement of the packer components which set the anchor slips and the sealing elements may be produced either hydraulically or mechanically.

After the packer or bridge plug has been set and sealed against the well casing bore, it should maintain sealing engagement upon removal of the hydraulic or mechanical setting force. Moreover, it is essential that the packer or bridge plug remain locked in its set and sealed configuration while withstanding hydraulic pressure applied externally or internally from the formation and or manipulation of the tubing string and service tools without unsetting the packer or bridge plug or without interrupting the seal. This is made more difficult in deep wells in which the packer or bridge plug and its components are subjected to high downhole temperatures, for example temperatures up to and exceeding 400° F., and high downhole pressures, for example, 5,000 pounds per square inch ("psi").

One common problem with packers and bridge plugs is the release of their slip assemblies prematurely. In passing through restrictions in the wellbore or when encountering debris, the slip assembly can be released thereby prematurely engaging the casing.

BRIEF DESCRIPTION OF THE DRAWINGS

FIG. 6 is representation of the J-slot in the locked position when the isolation apparatus is in the unset position illustrated in FIG. 5.

DETAILED DESCRIPTION

Figure 1A:
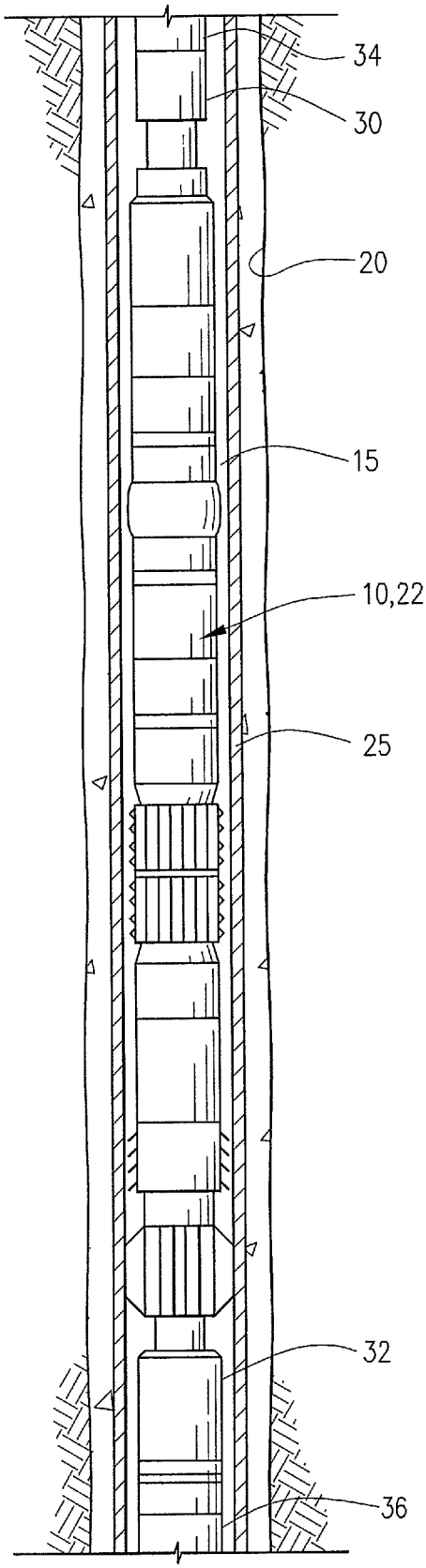
FIGS. 1A and 1B schematically show the isolation apparatus disposed in a wellbore in an unset and a set position, respectively.

In the description that follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like as used herein shall mean in relation to the bottom or furthest extent of the surrounding wellbore even though the wellbore or portions of it may be deviated or horizontal. The terms "inwardly" and "outwardly" are directions toward and away from, respectively, the geometric axis of a referenced object. Where components of relatively well-known design are employed, their structure and operation will not be described in detail.

Figure 1B:
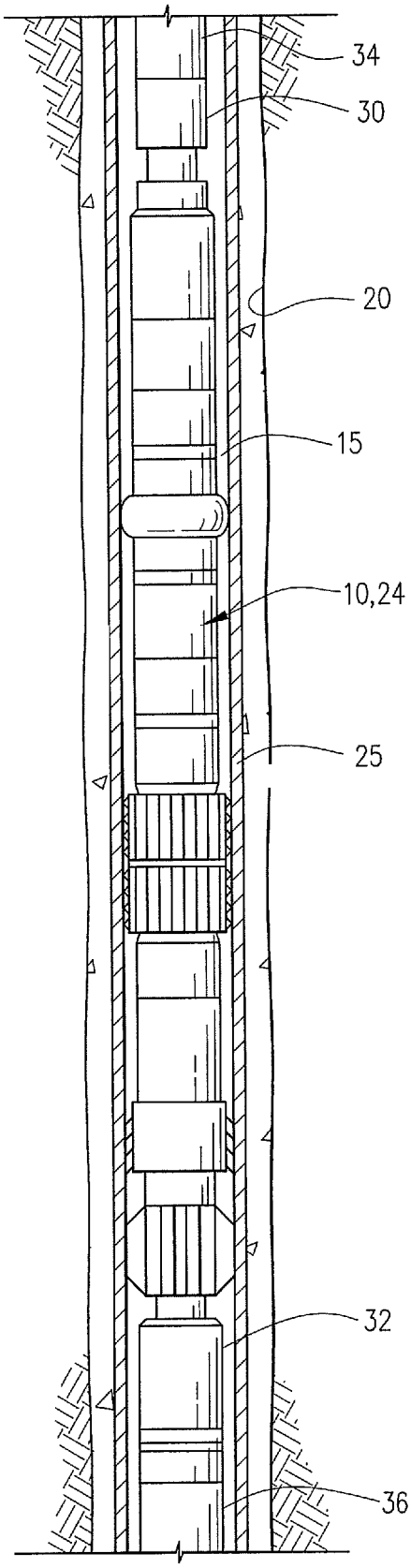

Referring now to the drawings, and more specifically to FIGS. 1A and 1B, a well packer or bridge plug, generally referred to herein as isolation apparatus 10, is schematically shown lowered into a well 15. Well 15 comprises a wellbore 20 having a casing 25 disposed therein. Isolation apparatus 10 is schematically shown in its unset position 22 in FIGS. 1A and 2A-2D. Isolation apparatus 10 is schematically shown in a partial set position (unidirectional slips deployed and bidirectional slips not deployed) in FIGS. 3A-3D. Isolation apparatus 10 is schematically shown in its set position 24 in FIGS. 1B, 4A-4D. Isolation apparatus 10 has an upper end 30 and a lower end 32. Upper end 30 is adapted to be connected to another tool, a work string, or a tubing string 34 of a type known in the art to be lowered into and moved within the well 15 thereon. Lower end 32 can be adapted to be connected to downhole equipment and/or tools 36 utilized in the course of treating and preparing wells for production or to production tubing and/or other production equipment, such as but not limited to, production screens, polished nipples and tail screens. However, it is not required that lower end 32 be connected to downhole equipment or tools.

Figure 2A:
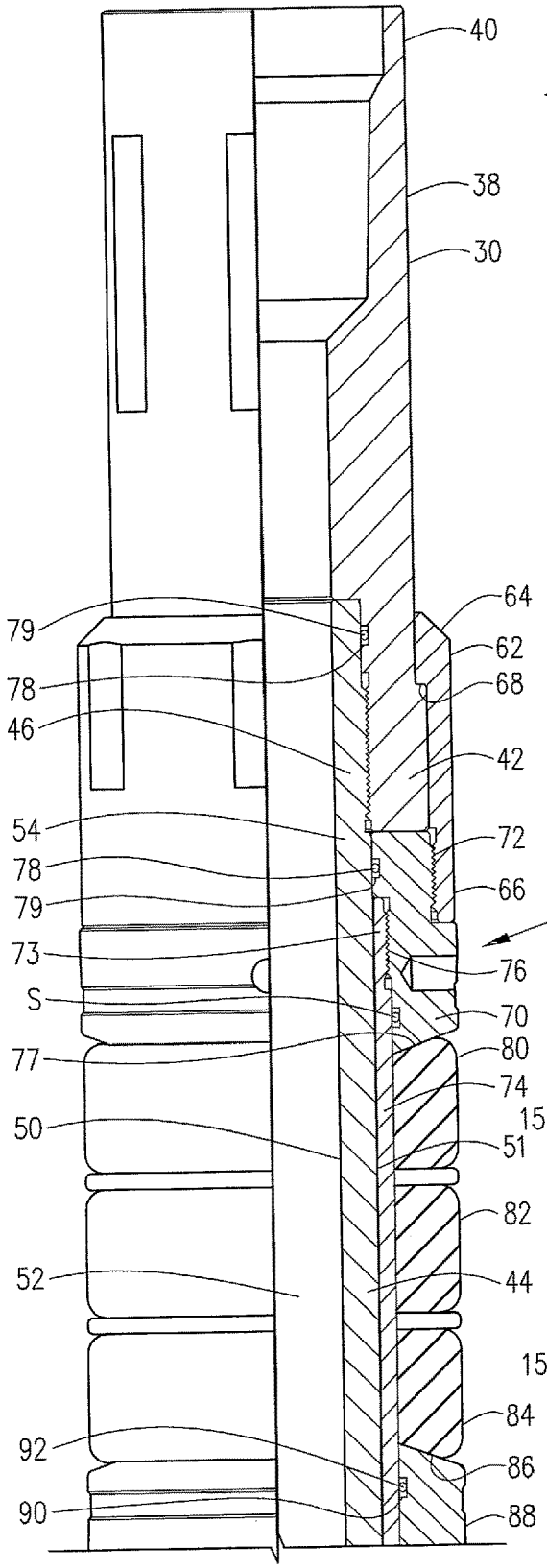
FIGS. 2A through 2D show a partial sectional view of the isolation apparatus in an unset position with the slips retracted.

Turning to FIG. 2A, isolation apparatus 10 has an adapter 38 at upper end 30. Adapter 38 has an upper end 40 and a lower end 42. Adapter 38 is adapted to connect to another tool, a work string or tubing 34.

Isolation apparatus 10 is further comprised of mandrel 44, which may be one or more mandrels. Mandrel 44 has an upper end 46 and a lower end 48 (FIG. 2D). Upper end 46 is threadedly connected to adapter 38 and lower end 48 is threadedly connected to an adapter 49 (FIG. 2D), which can be adapted to be connected to downhole equipment therebelow but does not have to be so connected. Mandrel 44 has an inner surface or wall 50 defining a longitudinal flow passage 52 for the communication of fluids therethrough, and has an outer surface or wall 51. As used herein, "axial" or "axially" generally refer to the direction longitudinally along the mandrel in an uphole or downhole direction and "radially" refers to a direction perpendicular to the axial direction.

Mandrel 44 includes an upper portion 54 (FIGS. 2A and 2B), central portion 56 (FIGS. 2B and 2C) and a lower portion 58 (FIGS. 2C and 2D), which can be threadedly connected together. A packer body 60 is disposed about upper portion 54. Packer body 60 includes a cap 62 having an upper end 64 and a lower end 66. Upper end 64 engages upward facing shoulder 68 defined on adapter 38. Lower end 66 threadedly engages upper packer pushing shoe 70 by threads 72 on the inner surface of cap 62 and outer surface of upper pushing shoe 70. The inner surface of upper pushing shoe 70 threadingly engages upper end 73 of packer sleeve 74 by means for threads 76. Upper packer pushing shoe 70 has an inclined downward facing shoulder 77, which engages an upper sealing element 80. Upper pushing shoe 70 is sealingly disposed about mandrel 44 and thus has a groove 78 with an O-ring 79.

Packer body 60 is shown with three sealing elements: upper sealing element 80, middle sealing element 82 and lower sealing element 84. As will be appreciated, packer body 60 can have more or less than three elements. Sealing elements 80, 82, 84 may be comprised of elastomeric material such as for example nitrile rubber, VITON® FKM (Vicon) FLOREL® or AFLAS. The examples provided herein are non-limiting. The three sealing elements are disposed about packer sleeve 74. Lower sealing element 84 engages an inclined upward facing shoulder 86 of lower pushing shoe 88 of packer body 60. Lower pushing shoe 88 is in sliding relation with packer sleeve 74. Further, lower pushing shoe 88 is sealingly disposed about packer sleeve 74 and thus has a groove 90 with an O-ring 92. There are a number of locations along the length of isolation apparatus 10 wherein seals have been disposed in grooves defined in the inner or outer surface of mating parts. Rather than specifically identifying each seal, seals will be designated by the letter "S" and it will be understood that such seals may include O-ring seals, back-up seals and other any type of seal known in the art utilized to create a seal between mating parts. Designation by the letter "S" does not indicate that all seals are identical, but simply that seals of a type known in the art may be utilized.

Figure 2B:
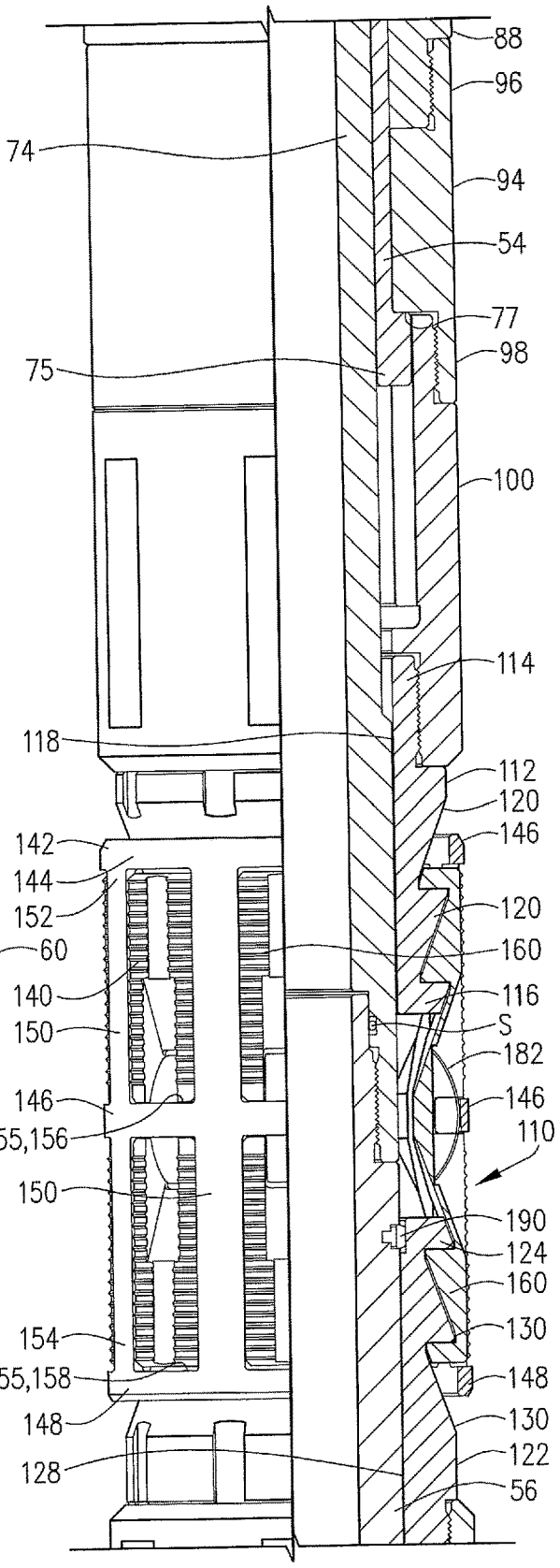

Turning to FIG. 2B, lower pushing shoe 88 is coupled to outer sleeve 100 by coupling 94, which is threadedly connected at upper end 96 to lower pushing shoe 88 and is threadedly connected at lower end 98 to outer sleeve 100. Further, the lower end 75 of packer sleeve 74 forms an upward facing shoulder 77, which engages coupling 94 so as to limit downward movement of coupling 94 and lower pushing shoe 88, except in association with downward movement of mandrel 44.

As will be appreciated by the above description, cap 62, upper pushing shoe 70 and sleeve 74 are held in fixed relation with mandrel 44. However, lower pushing shoe 88 can slide upward in relation to mandrel 44. When lower pushing shoe 88 slides upward it places axial pressure on the sealing elements 80, 82 and 84, which cause them to radially expand to make sealing engagement with casing 25.

Downhole from outer sleeve 100 is bidirectional slip assembly 110, which comprises upper slip wedge 112, lower slip wedge 122, and bidirectional slip 140. Upper slip wedge 112 has an upper end 114 and lower end 116, and is threadedly connected at upper end 114 to outer sleeve 100. Upper slip wedge 112 has an inner surface 118 closely received about mandrel 44 in sliding relation. Upper slip wedge 112 has a plurality of upper wedge cones 120 defined on the exterior thereof.

Figure 2C:
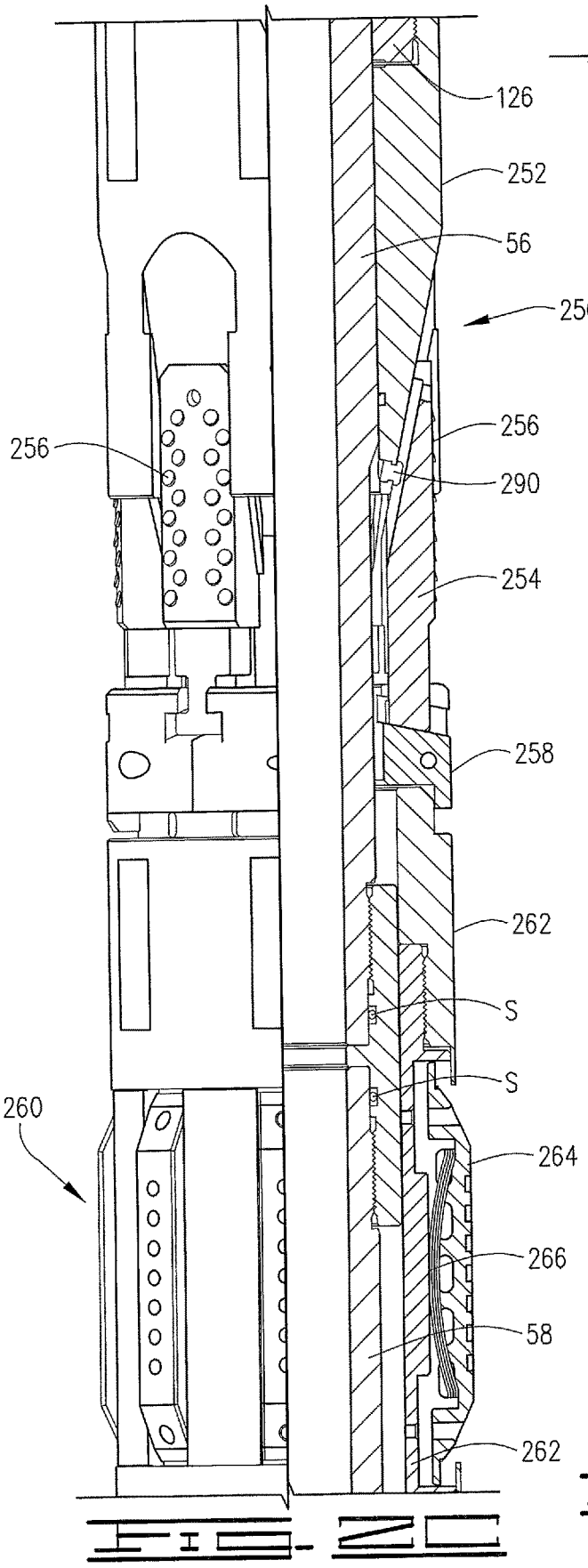
Figure 2D:
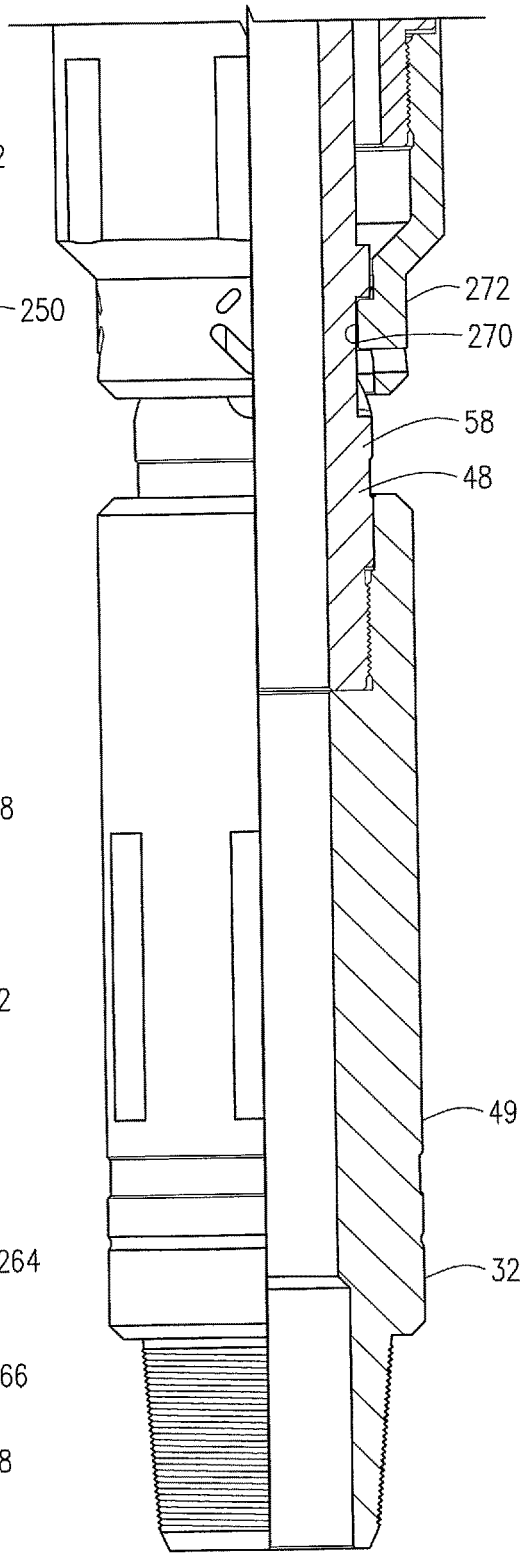
Figure 3A:
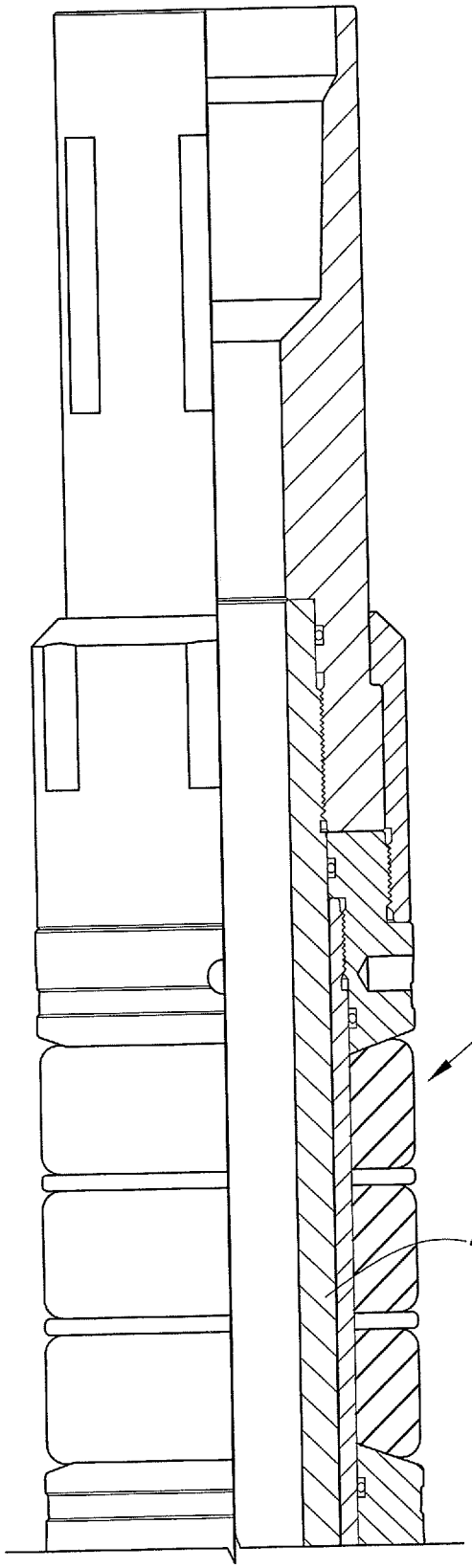
FIGS. 3A through 3D show partial section views of components of the isolation apparatus in a partial set position in which the unidirectional slips are deployed but the bidirectional slips are not yet deployed.
Figure 3B:
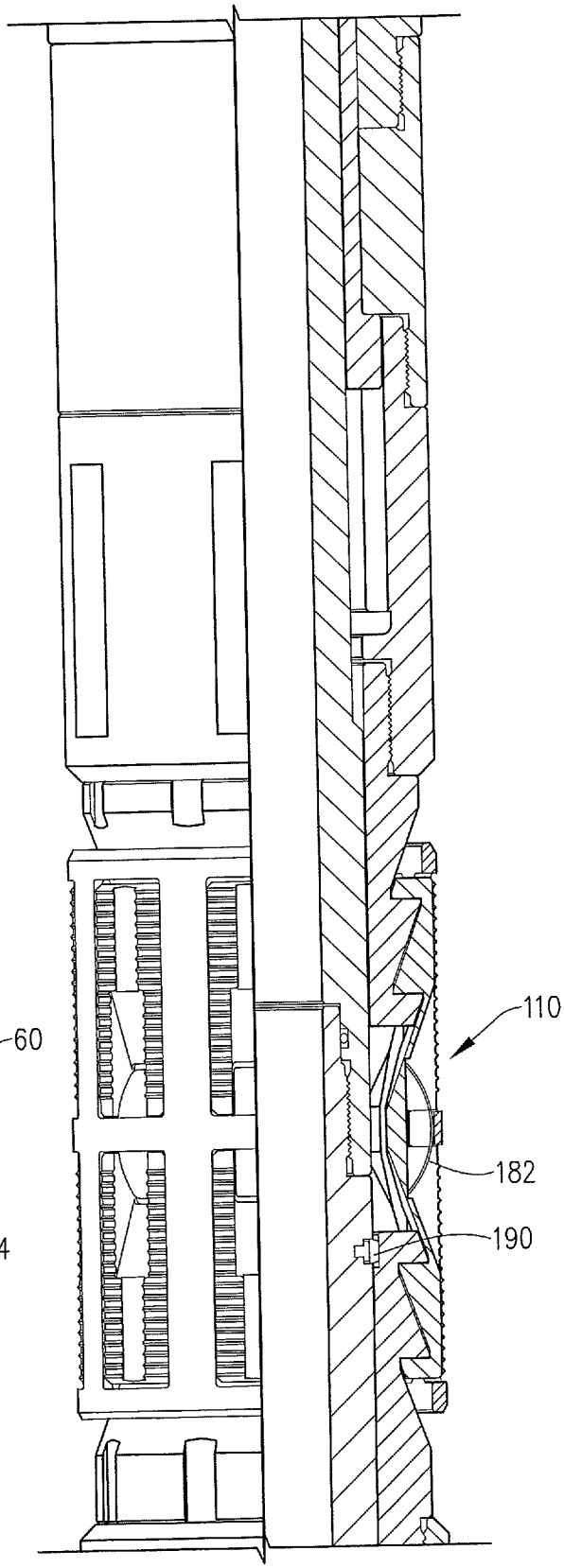
Figure 3C:
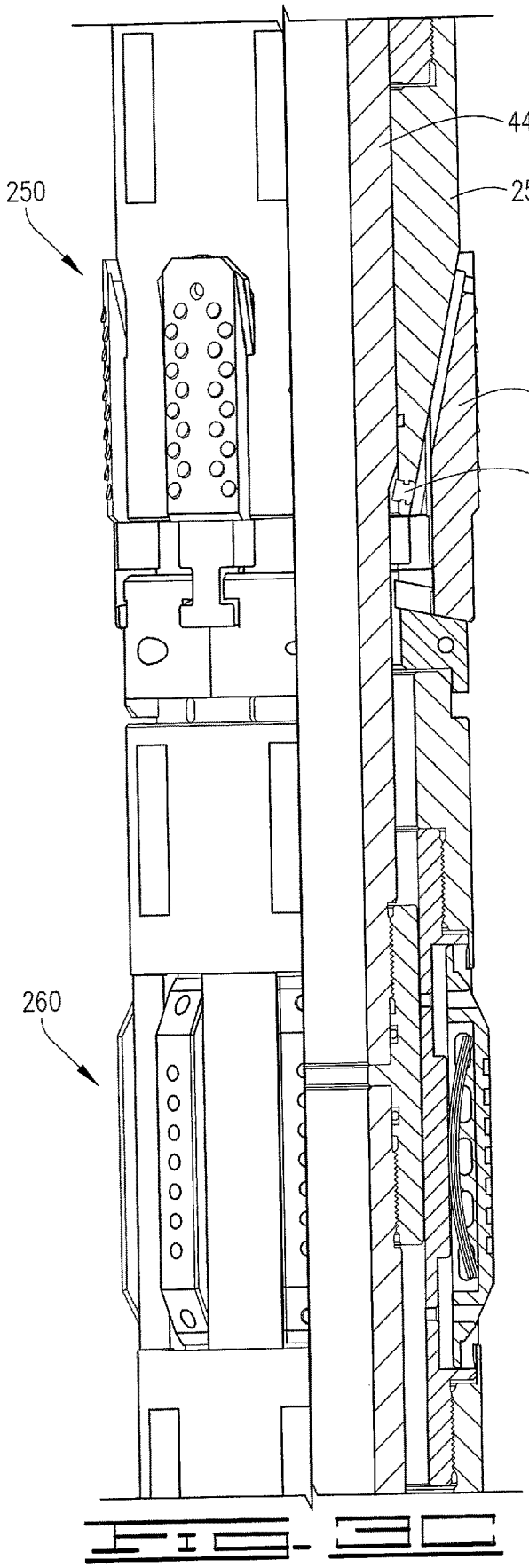
Figure 3D:
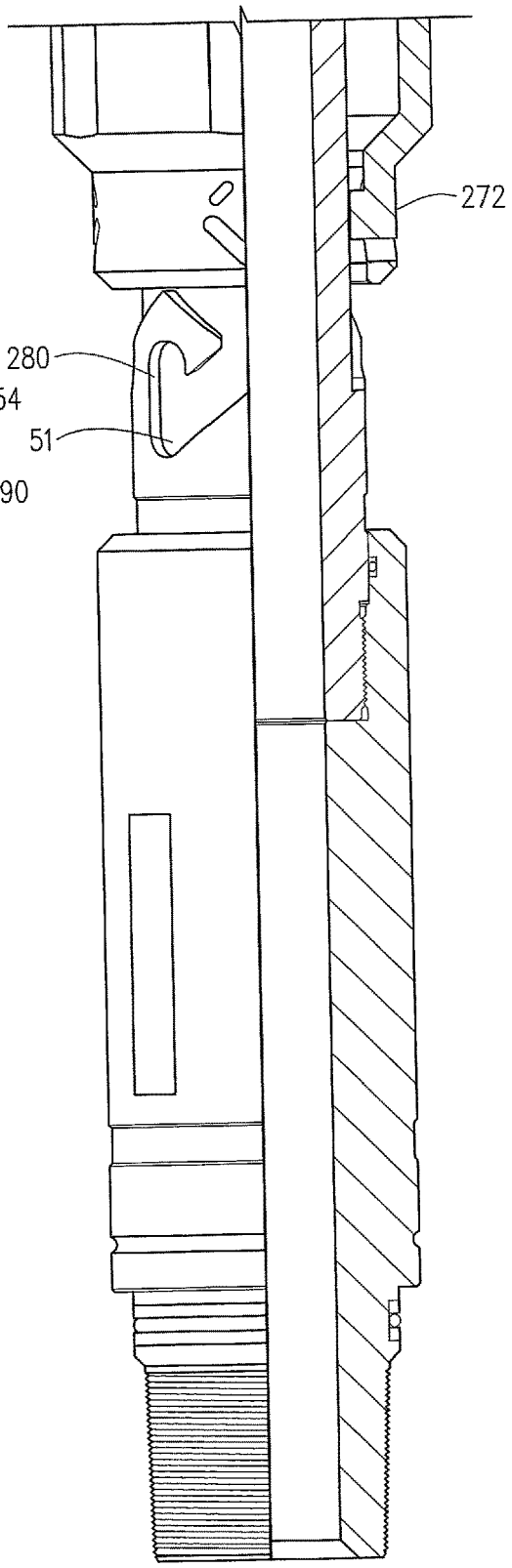
Figure 4A:
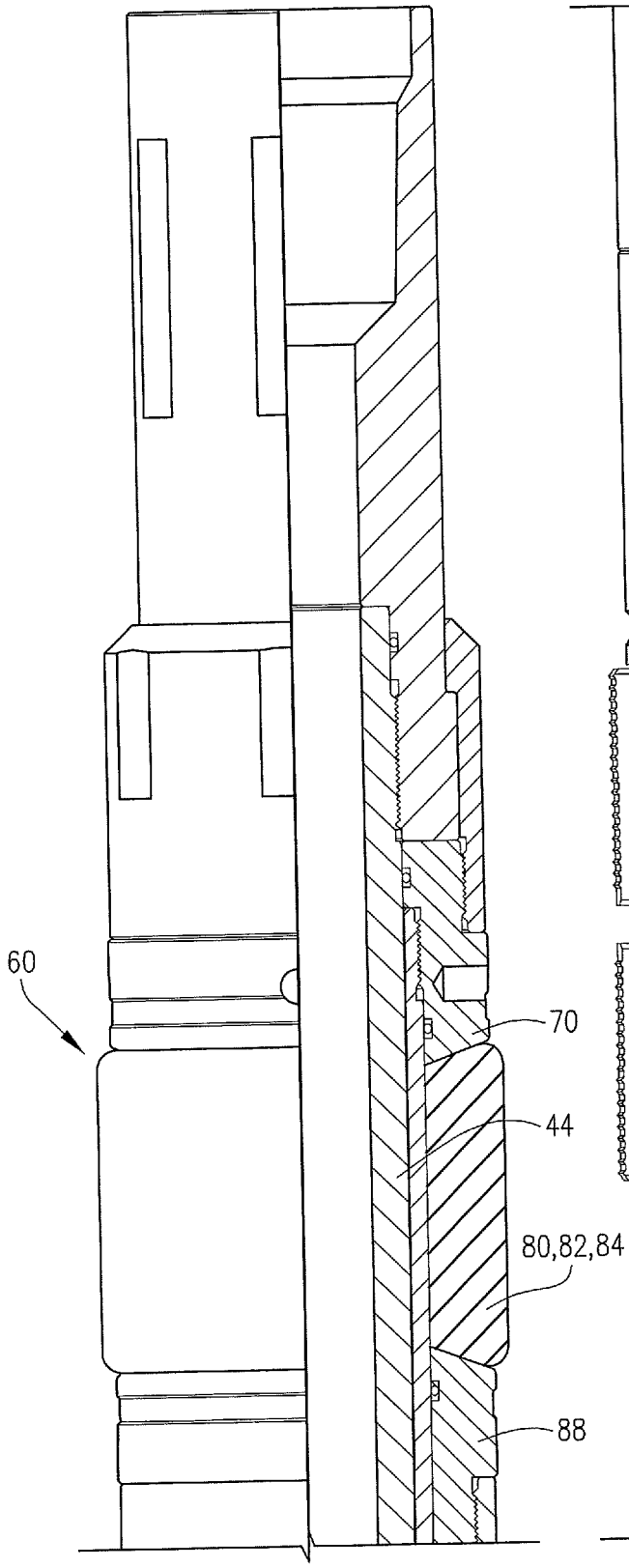
FIGS. 4A through 4D show partial sectional views of components of the isolation apparatus in the set position in which both the unidirectional slips and bidirectional slips are deployed.
Figure 4B:
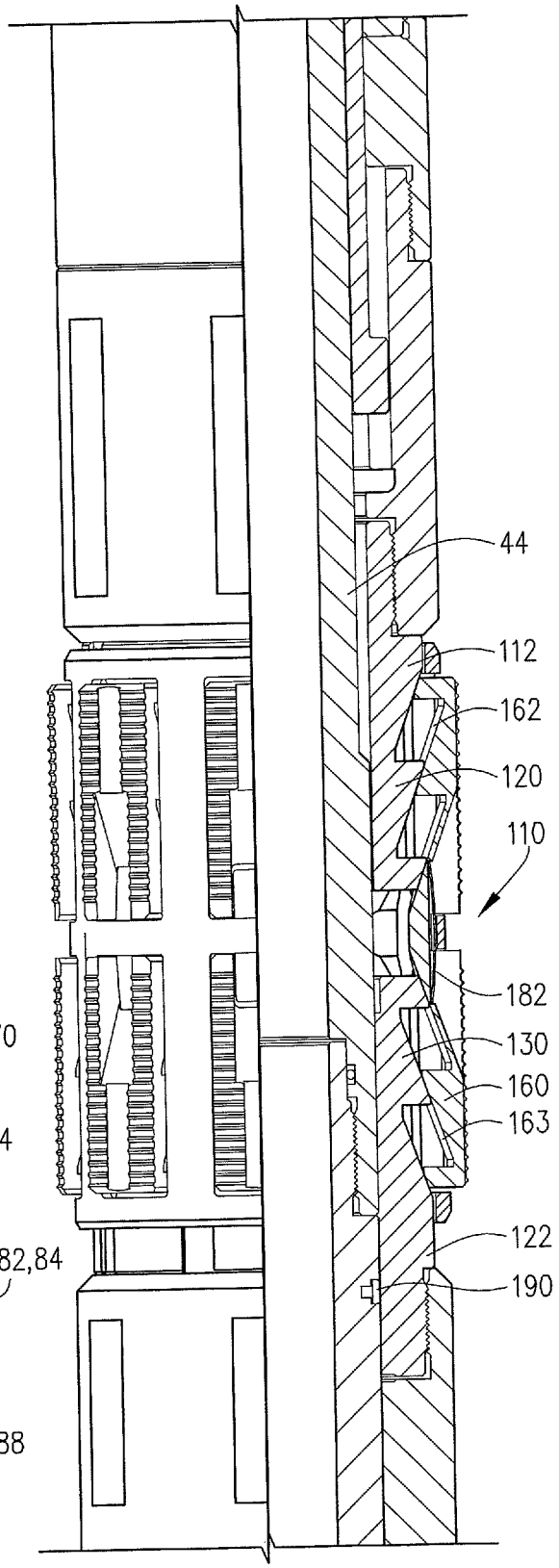
Figure 4C:
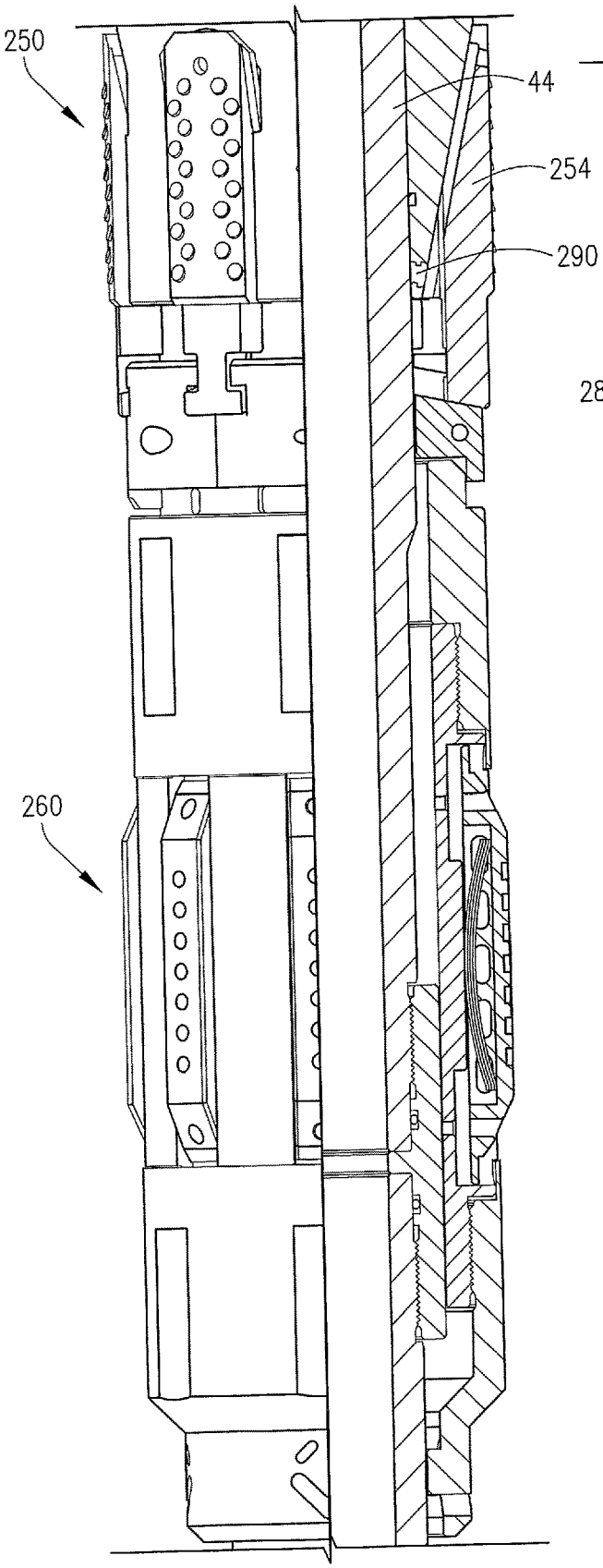
Figure 4D:
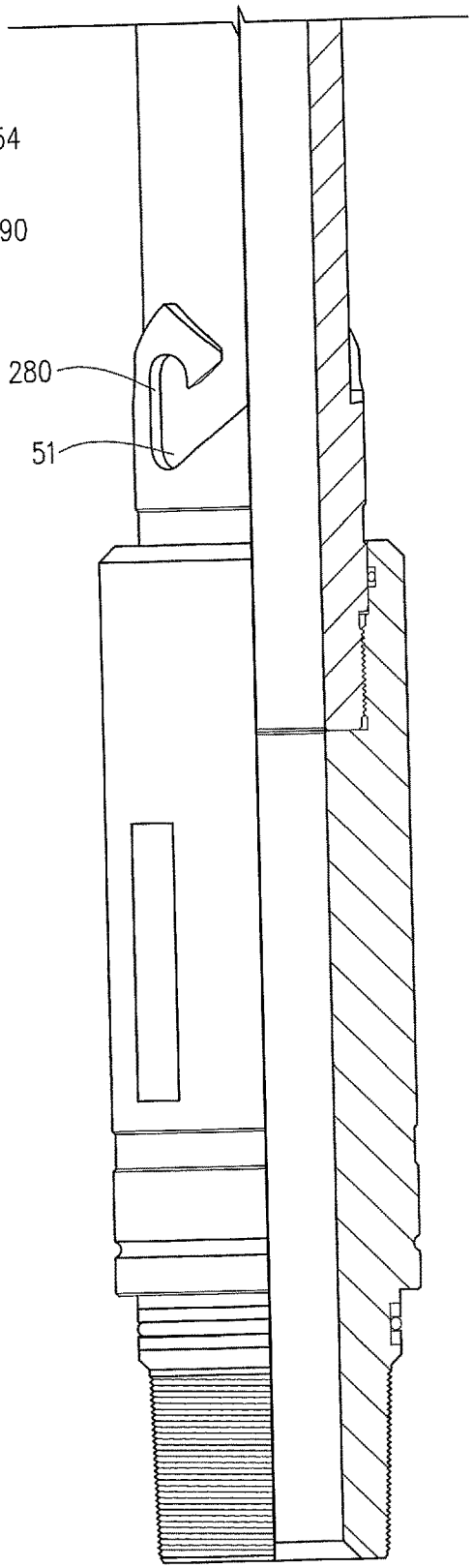

Lower slip wedge 122 has an upper end 124, a lower end 126 (FIG. 2C) and an inner surface 128 closely received about mandrel 44 in sliding relation. A plurality of lower wedge cones 130 are defined on the exterior of lower slip wedge 122. Lower wedge cones 130 are on opposition to upper wedge cones 120; that is, they are in opposite directions with lower wedge cone 130 inclining radially outward in a downhole direction and upper wedge cone 120 inclining radially outward in an uphole direction. At lower end 126, lower slip wedge 122 is attached to slip wedge 252 of unidirectional slip assembly 250 (FIG. 2C).

Figure 11:
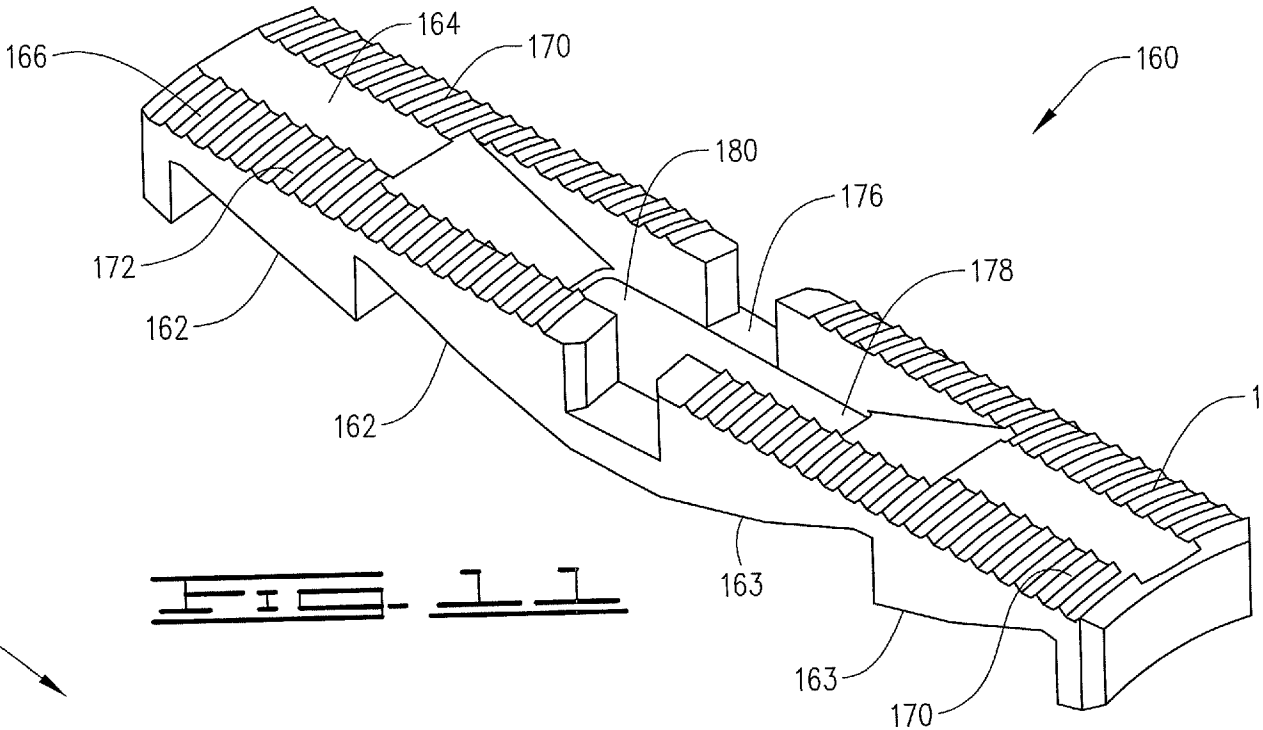
FIG. 11 is a perspective view of a bidirectional slip bank.
Figure 12:
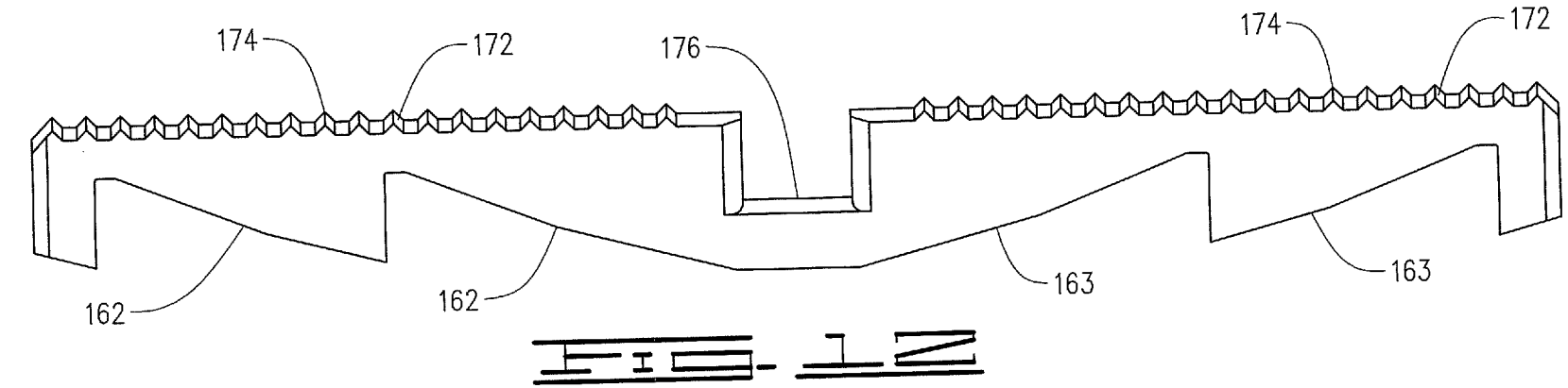
FIG. 12 is a side view of a bidirectional slip bank.

Referring now to FIGS. 2B, 11 and 12, bidirectional slip 140 comprises a slip frame 142, and a plurality of bidirectional slip banks 160. Slip frame 142 generally forms a unitary structure having an uphole ring 144, center ring 146, a downhole ring 148 and a plurality of longitudinally extending slats 150. As can be seen from FIG. 2B, each slat is connected at an uphole end 152 to uphole ring 144 and is connected at a downhole end 154 to downhole ring 148. Further, each slat 150 is connected to center ring 146 at a position between uphole end 152 and downhole end 154, typically approximately midway. Slats 150 are spaced radially about the center ring so as to define a plurality of slot pairs 155, each comprising an upper slot 156 extending longitudinally uphole from center ring 146 and a lower slot 158 extending longitudinally downhole from center ring 146. For each slot pair 155, upper slot 156 and lower slot 158 are longitudinally aligned.

Bidirectional slip bank 160 has a first gripping bank 166 and a second gripping bank 168. Each bidirectional slip bank 160 is positioned in slip frame 142 such that it mates with a slot pair with first gripping bank 166 positioned in upper slot 156 of the slot pair and second gripping bank 168 positioned in lower slot 158 of the slot pair. Each bidirectional slip bank 160 can radially slide from an unset position to a set position, which is radially outward from the unset position.

First gripping bank 166 and a second gripping bank 168 form part of upper surface 164 of bidirectional slip bank 160. Each gripping bank 166, 168 have an outer gripping surface 170 configured to grip the casing when the bidirectional slip bank is in the set position. Outer gripping surface 170 comprises gripping elements 172 having gripping edges 174 wherein gripping edges 174 are aligned with the radial axis of the slip; that is, the radial axis of the mandrel. Generally, the gripping elements 172 can be a series of laterally extending wickers (as shown in FIG. 12) with each wicker aligned with the radial axis of the slip. In other words, each wicker is aligned such that its gripping edge 174 protrudes directly radially outward and not angled in an uphole or downhole direction. By protruding directly radially outward, gripping edge 174 provides gripping to enable equal protection against both uphole and downhole forces that would otherwise cause isolation apparatus 10 to move downhole or uphole, respectively.

The number of gripping elements on gripping banks 166, 168 is such that bidirectional slip bank 160 may be expanded to grippingly engage and hold packer 10 in place with respect to casing 25. When packer 10 is utilized for high temperature, high-pressure applications, a carburized grade of steel, such as 1018 or 8620 heat-treated alloy steel can be used for the bidirectional slip bank 160.

Between first gripping bank 166 and second gripping bank 168 is a laterally extending center groove 176. Transverse to center groove 176 is a longitudinally extending center channel 178 having a channel surface 180. Center groove 176 is positioned below center ring 146 when bidirectional slip bank 160 is positioned in slip frame 142 so that center groove 176 can at least partially receive center ring 146 when bidirectional slip bank 160 is in the set position. Further, a spring 182 is positioned in center channel 178 between center ring 146 and channel surface 180. Spring 182 bias the bidirectional slip bank 160 to the unset position. For example, spring 182 can be bow spring.

Bidirectional slip bank 160 has an inner surface with a series of surface wedges 162, 163. Upper surface wedges 162 are opposed to lower surface wedges 163; that is, they are arranged in opposite directions. Upper surface wedges 162 are positioned adjacent to and generally complementary with upper wedge cones 120 of upper slip wedge 112. Lower surface wedges 163 are positioned adjacent to and generally complementary with lower wedge cones 130 of lower slip wedge 122. Thus, when upper slip wedge 112 and lower slip wedge 122 move longitudinally so as to approach each other, bidirectional slip bank 160 will be moved radially outward to the set position by interaction of wedge cones 120, 130 with surface wedges 162, 163, respectively. Subsequently, when upper slip wedge 112 and lower slip wedge 122 move longitudinally away from each other, bidirectional slip bank 160 will be moved radially inward to the unset position by the biasing of spring 182.

As can best be seen for FIGS. 13-16, a pre-set mechanism 190 is used to prevent relative movement between mandrel 44 and lower slip wedge 122 until a predetermined load is applied to mandrel 44 of isolation apparatus 10. The pre-set mechanism 190 comprises a slotted detent ring or compression ring 200. Detent ring 200 is generally tubular-shaped or ring-shaped and has a first circumferential end 202 and second circumferential end 204 which define a slot or gap 206. Accordingly, detent ring 200 has a first inner diameter or free diameter when detent ring 200 is in a relaxed state and a second inner diameter, which is smaller than the free diameter, when detent ring 200 is radially compressed and the width of slot 206 is decreased in size. The smallest diameter of detent ring 200 is when it is compressed such that first circumferential end 202 is in contact with second circumferential end 204.

Detent ring 200 has an outer surface 208, inner surface 210, upper edge 212 and lower edge 214. Detent ring 200 has an upper lead angle 216 extending between upper edge 212 and outer surface 208, and a lower lead angle 218 extending between lower edge 214 and outer surface 208. For some embodiments, detent ring 200 will only need one of the lead angles.

Figure 13:
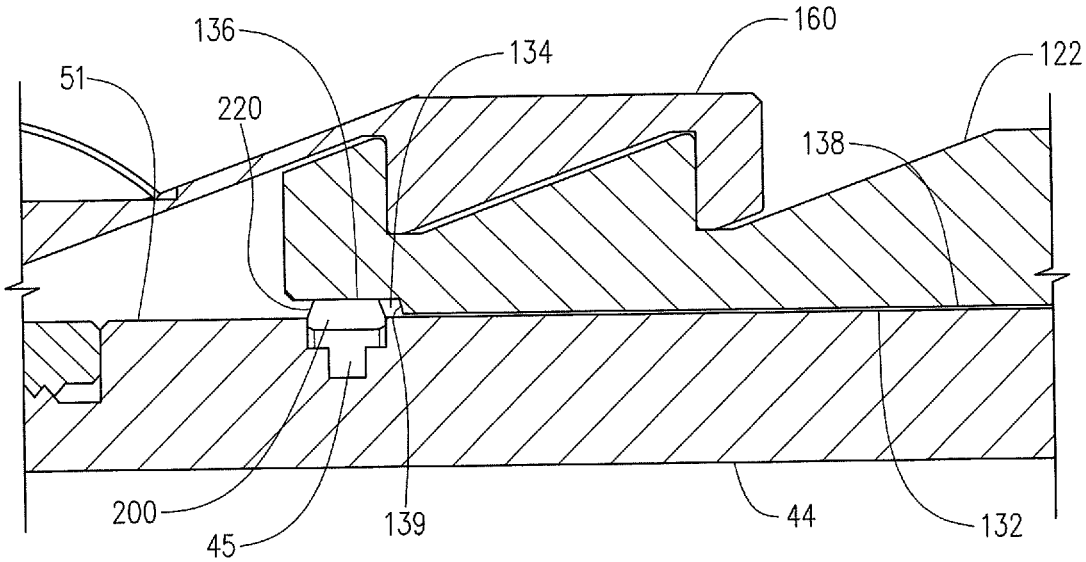
FIG. 13 is an enlarged view of the pre-set mechanism utilized with the bidirectional slips. The pre-set mechanism is shown in its position when the bidirectional slip has not been deployed.
Figure 14:
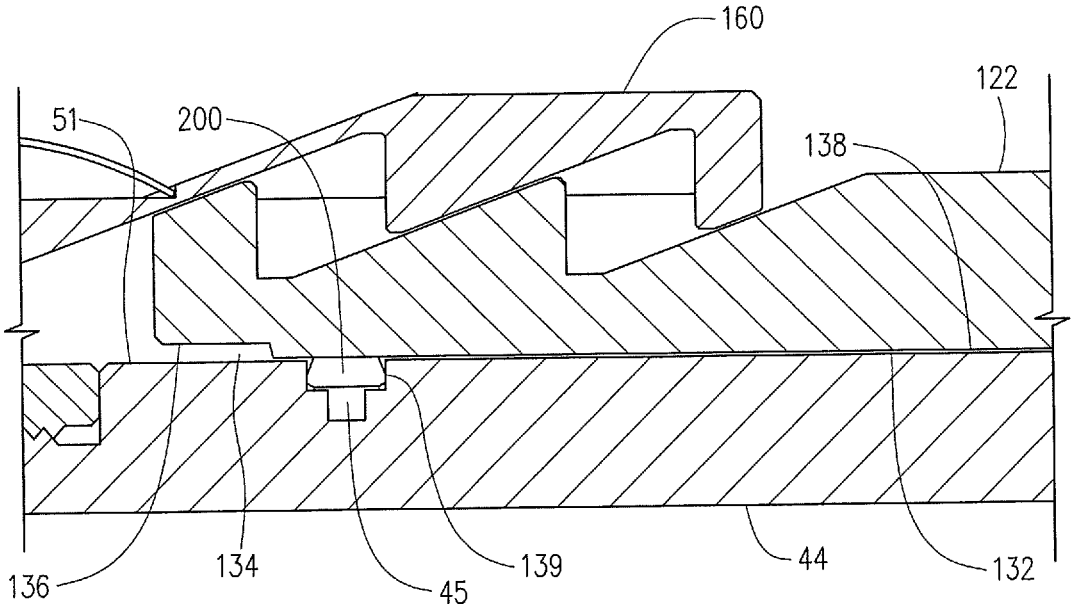
FIG. 14 is an enlarged view of the pre-set mechanism utilized with the bidirectional slips. The pre-set mechanism is shown in its position when the bidirectional slip is deployed.
Figure 15:
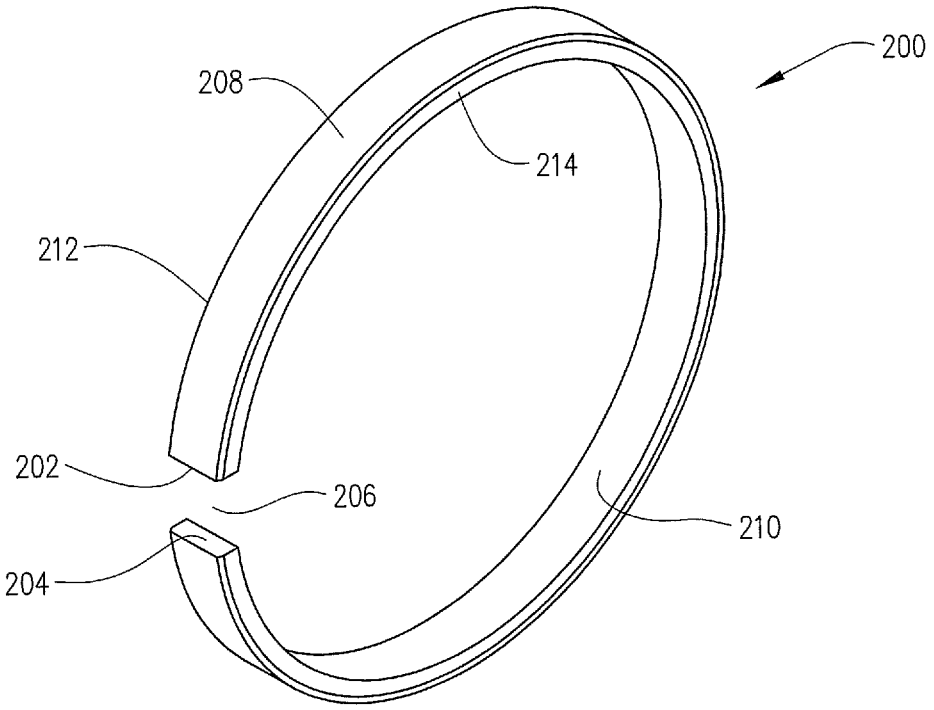
FIG. 15 is a perspective view of a slotted detent ring in accordance with some embodiments.
Figure 16:
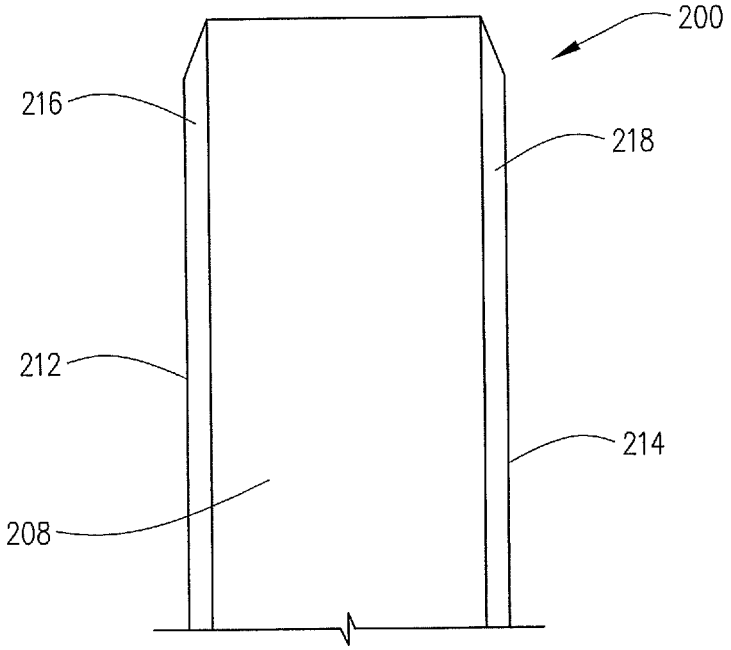
FIG. 16 is a side view of a portion of the slotted detent ring illustrated in FIG. 15.

Referring to FIGS. 13 and 14, detent ring 200 is positioned in a groove 45 defined in mandrel 44. Groove 45 has a depth such that detent ring 200 can be compressed into groove 45 so as not to extend outside of outer surface 51 of mandrel 44. However, in its relaxed state, at least a first portion 220 of detent ring 200 extends above outer surface 51 of mandrel 44. The first portion 220 of detent ring 200 extends out into a grooved case 134 formed in inner surface or wall 132 of lower slip wedge 122. Grooved case 134 is formed by a first portion 136 of inner surface 132 having a diameter that is larger than a diameter of a second portion 138 of inner surface 132, thus forming a shoulder 139. Shoulder 139 is generally an angled shoulder. Additionally, the diameter of first portion 136 is typically slightly smaller than the free diameter of the detent ring and larger than the diameter of mandrel surface 132.

Accordingly, when isolation apparatus 10 is in the unset position 22, detent ring is in the position shown in FIG. 13. As a downward load is applied to mandrel 44, lower slip wedge 122 resist movement relative to mandrel 44 because of the interaction of shoulder 139 and lead angle 218. Once the downward load to mandrel 44 exceeds a predetermined amount, detent ring 200 is compressed by the interaction of shoulder 139 and lead angle 218; thus, detent ring is compressed into groove 184 so that it no longer extends above outer surface 51. Lower slip wedge 122 is now able to move relative to mandrel 44 so as to place the second portion 138 over detent ring 200 and to move lower slip wedge 122 relative to bidirectional slip bank 160, as can be seen in FIG. 14. This relative movement causes lower slip wedge 122 to approach upper slip wedge 112; thus, bidirectional slip bank 160 will be moved radially outward to the set position by interaction of wedge cones 120, 130 with surface wedges 162, 163, respectively. When the load is subsequently reduced below the predetermined force, the lower slip wedge 122 slides axially relative to the mandrel 44 so as to place the first portion 136 of the inner wall over the detent ring such that the detent ring moves to the relaxed state. The amount of load needed to exceed the predetermined force and thus activate the pre-set mechanism to allow relative movement between the parts is determined by the severity of lead angle and angled shoulder and also by the thickness and material of construction of detent ring 200. Typically, the detent ring will be constructed of metal such as steel or brass; however, one skilled in the art can readily determine the design of the pre-set mechanism to achieve different predetermined forces based on the disclosure herein. Additional embodiments will be readily apparent to one skilled in the art based on the disclosure herein. For example, case groove 134 can have an angled shoulder on each side of detent ring 200 in the unset position. The uphole shoulder interacting with upper lead angle 216 and the downhole shoulder interacting with lead angle 218. Thus, preventing restricting movement in either direction without a suitable load being applied.

Turning now to FIG. 2C, lower end 126 of lower slip wedge 122 is threadedly connected to slip wedge 252 of unidirectional slip assembly 250. Unidirectional slip assembly 250 is a mechanical slip assembly disposed about mandrel 44 below bidirectional slip assembly 110. Unidirectional slip assembly 250 is a type known in the art and thus includes a slip wedge 252 engaging a plurality of slips 254 therebelow. Slips 254 include gripping elements 256 on their outer surface. Typically, gripping element 256 will be angled in a downhole direction so that they provide protection against downhole movement of the well packer 10 during stetting to bidirectional slip assembly 110. Generally, gripping elements 256 will be buttons but can be angled wickers.

Slip assembly 250 includes a slip collar 258. Slips 254 are attached to slip collar 258 so that longitudinal movement of slip collar 258 in either an uphole or downhole direction results in a similar movement of slips 258. Slip collar 258 is in turn attached to a drag block assembly 260. Slip collar 258 can be a split collar assembly as is known in the art.

Additionally, slip assembly 250 can include a pre-set mechanism 290. Pre-set mechanism 290 is identical to pre-set mechanism 190, except that the pre-set mechanism can be located between slip wedge 252 and slips 254; thus, the detent ring can be positioned in a groove in slip wedge 252 and the angled lead edge of the detent ring interacts with an angled shoulder on slips 250.

Figure 10:
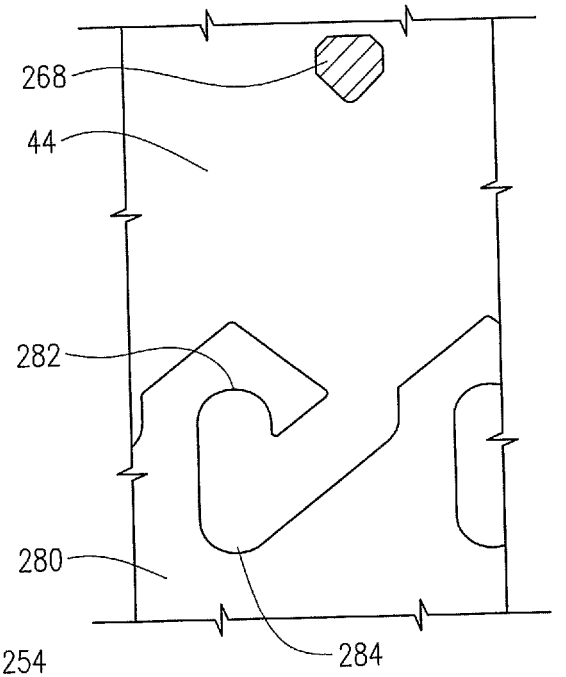
FIG. 10 is a representation of the J-slot in the unlocked position for the isolation apparatus in the position illustrated in FIG. 9.

Drag block assembly 260 may be of a type known in the art and thus may include a drag block sleeve 262 having a drag block 264 connected thereto with drag springs 266 disposed therein. Although drag block assembly 260 is in most aspects identical to prior art drag block assemblies, it includes lugs 268 that interact with a plurality of J-slot 280 defined on mandrel 44, (best seen from FIGS. 6, 8 and 10). Lugs 268 are on inner surface 270 at lower end 272 of drag block assembly 260. J-slot 280 is defined on outer surface 51 of mandrel 44 and is further described below.

Figure 5:
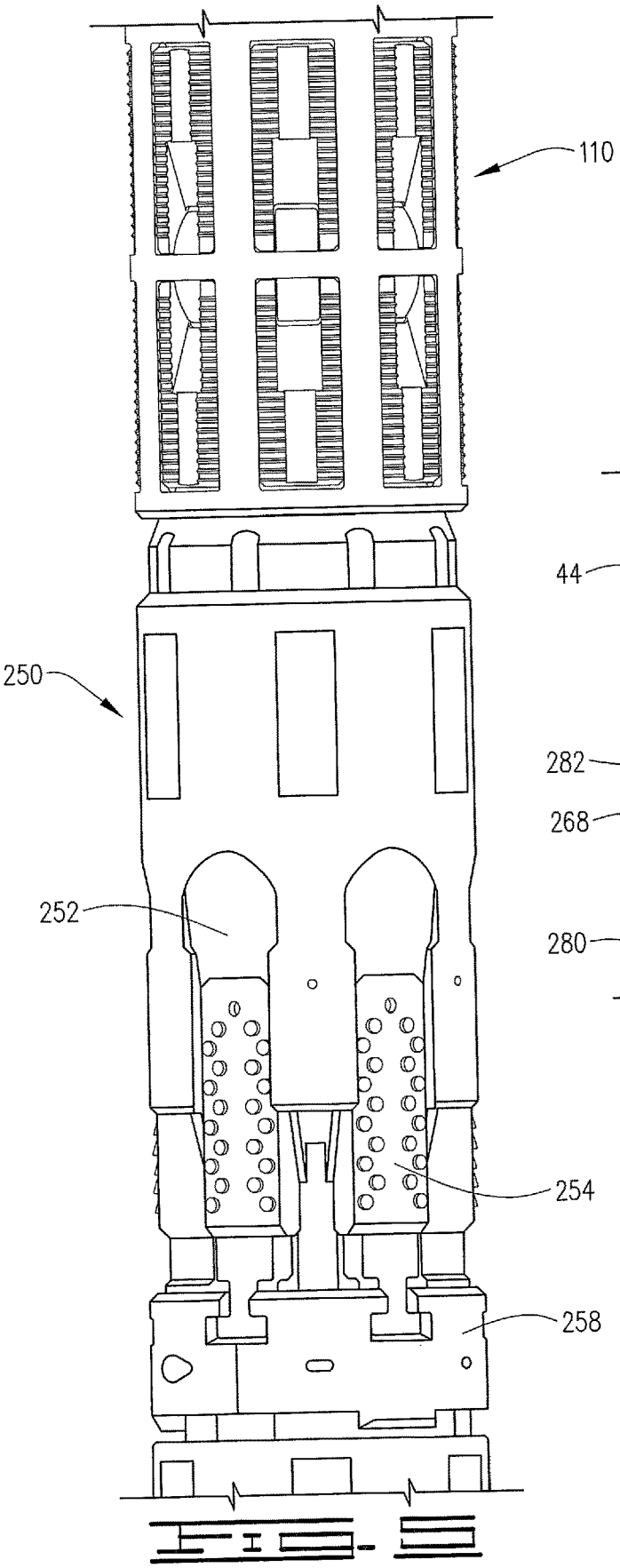
FIG. 5 shows a frontal view of the slip components in an unset position with a locked J-slot.
Figure 5:
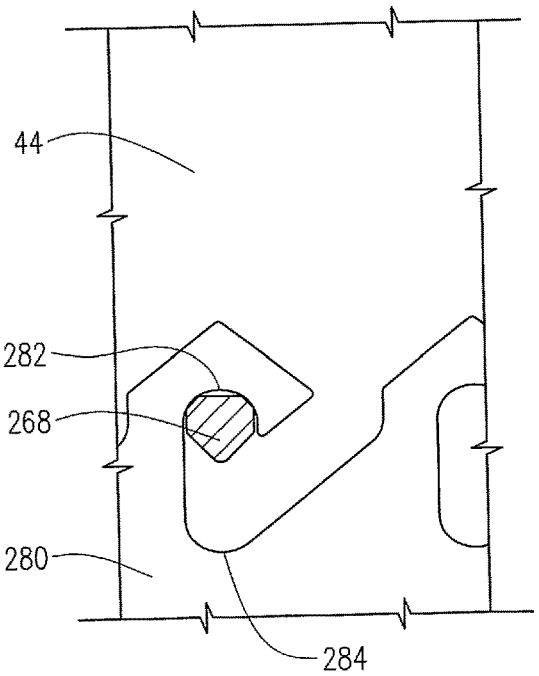

Isolation apparatus 10 is shown in FIGS. 2A through 2D in its initial running position and thus is in unset position 22. As can be seen from FIGS. 5 and 6, in the unset position lug 268 is locked in catch 282 of J-slot 280 and unidirectional slip assembly 250 has its slips 254 in an unset or retract position. Further, bidirectional slip assembly 110 has its bidirectional slips 140 in an unset or retracted position.

The operation of packer 10 is as follows. Packer 10 may be connected at its upper end to tubing 34 and lowered into a well, such as well 15. If equipment is attached to the lower end 48 of mandrel 44, it may be any desired type of equipment known in the art. As is well known in the art, packer 10 may be lowered through different sizes of casings such that the drag block assembly 260 can be bumped by the upper end of different diameters of casing as it is being lowered into the hole. J-slot 280 and lug 268 will prevent premature movement of the mandrel relative to the drag block and thus is a means for preventing apparatus 10 from prematurely moving from its unset position 24 to its set position 22. Drag block assembly 260 will be designed with a preselected outer diameter so that drag block 264 will be engaged and compressed by casing also having a predetermined or preselected diameter such as casing 25. Even after drag block 264 engages casing 25, mandrel 44 will not move downwardly relative to drag block 264 because of the J-slot and lug arrangement.

Figure 7:
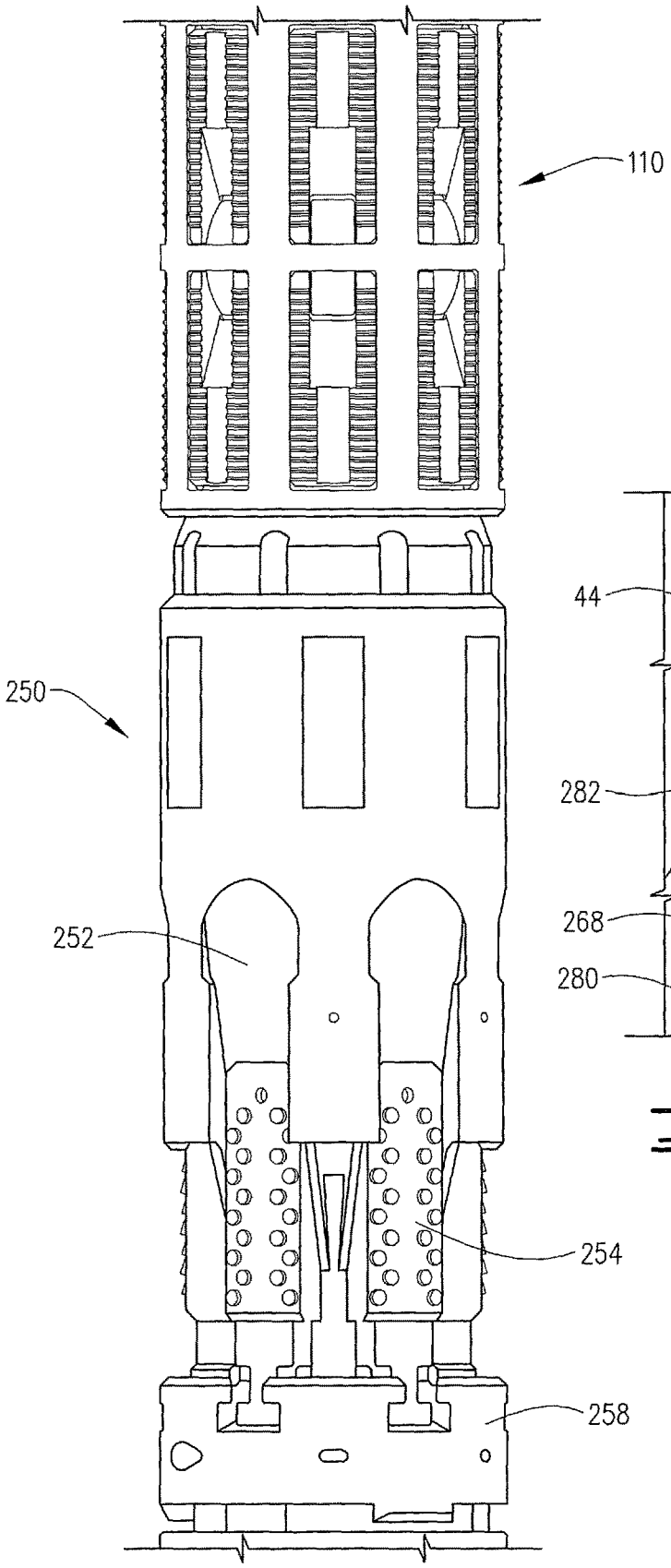
FIG. 7 shows a frontal view of the slip components in an unset position during unlocking of the J-slot.
Figure 8:
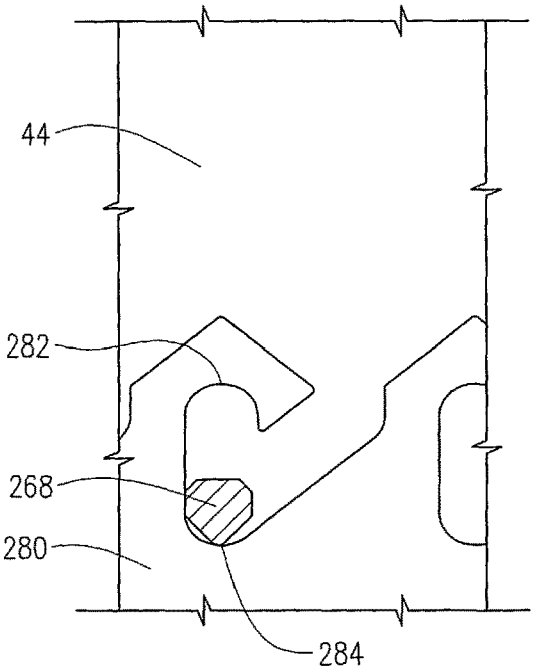
FIG. 8 is a representation of the J-slot during unlocking for the downhole tool in the position illustrated in FIG. 7.

Once isolation apparatus 10 has reached a desired location in the well 15, the isolation apparatus 10 can be moved from its unset position 24 to set position 22. In order to do so, upward pull is applied to tubing 34, which moves mandrel 44 uphole. Because of the drag caused by drag block 264, drag block assembly 260 does not move uphole or moves uphole less than mandrel 44. Thus, the upward movement of mandrel 44 moves lugs 268 from catch 282 to the bottom 284 of J-slot 280, as shown in FIG. 8. Also, as seen in FIG. 7, slips 254 of unidirectional slip assembly 250 move lower on slip wedge 252.

Figure 9:
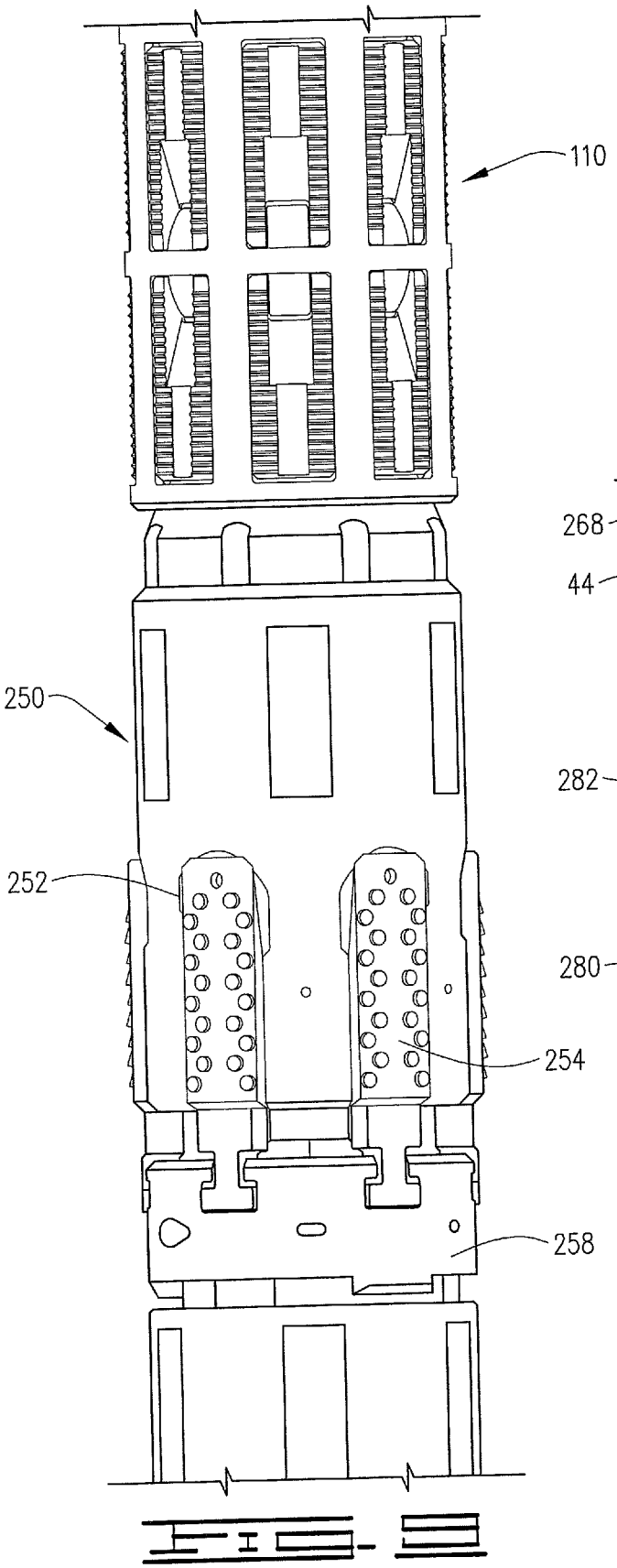
FIG. 9 shows a frontal view of the slip components in the partial set position, in which the unidirectional slips have been deployed but the bidirectional slips have not been deployed.

Next, tubing 34, and hence mandrel 44, is rotated so lugs 268 will be rotated and can travel upwardly from J-slots 280. Tubing 34 and mandrel 44 are then moved downwardly and will slide relative to drag block assembly 260. When the load driving mandrel 44 downwardly exceeds a first predetermined value, the pre-set mechanism 290 is activated so as to compress the associated detent ring and allow movement of slips 254 relative to slip wedge 252. The load will cause slips 254 to move relative to slip wedge 252 of unidirectional slip assembly 250. Thus, slip wedge 252 urges slips 254 outwardly to engage casing 25. Unidirectional slip assembly 250 will then have the configuration appearing in FIGS. 9 and 10 with lug 282 having moved upwards from J-slot 280 and slips 254 having moved up onto slip wedge 252 so as to be in the set position.

Pre-set mechanism 190 will typically require a second predetermined force to be activated. The second predetermined force being greater than the first predetermined force. Accordingly, bidirectional slip assembly 110 is not set until after unidirectional slip assembly 250. At this stage, isolation apparatus 10 has the configuration illustrated in FIGS. 3A through 3D.

After slips 254 engage casing 25, the second predetermined force is exceeded by continued application of the load to mandrel 44. The continued application of the load will place isolation apparatus 10 in its set position 22 as illustrated in FIGS. 4A through 4D. Accordingly, pre-set mechanism 190 is activated to allow movement of lower slip wedge 122 relative to mandrel 44 and upper slip wedge 112. Thus, upper slip wedge 112 and lower slip wedge 122 move closer together and drive bidirectional slip banks 160 outward. Bidirectional slip banks 160 will be driving radially outward by the relative movement between upper and lower wedge cones 120, 130 on upper and lower slip wedges 112, 122 and upper and lower surface wedges 162, 163 on bidirectional slip banks 160. The radial expansion will cause gripping elements 172 to engage casing 25.

The continued downward load will also cause upper, middle and lower sealing elements 80, 82, 84 to become compressed together between upper and lower pushing shoes 70, 88, and to be expanded radially outwardly to engage and seal against casing 25. Once isolation apparatus 10 is in its set position 22, production or other operations may be performed.

If it is desired to move isolation apparatus 10 and reset it in the well at a different location, an upward pull is applied. Mandrel 44 will move upward and spring 182 decompresses to move bidirectional slip bank 160 to its unset position such that engagement from casing 25 is released. Further, upper and lower slip wedges are moved apart to their unset position by the relative movement between upper and lower wedge cones 120, 130 on upper and lower slip wedges 112, 122 and upper and lower surface wedges 162, 163 on bidirectional slip banks 160. Continued downward movement of mandrel 44 moves unidirectional slip assembly 250 to its unset position such that engagement from casing 25 is released. Also, lugs 282 are placed in contact with J-slots 280. Mandrel 44 can then be rotated to place lugs 282 in the short leg of the J-slots 280. When a downward pull is applied, lugs 282 lock into catch 282 of J-slots 280.

Likewise, seal elements 80, 82, 84 will retract radially inwardly so that there is clearance between seal elements 80, 82, 84 and casing 25. The packer 10 is again in unset position 24. Although the isolation apparatus 10 may not be identically positioned as it is in its original, running, unset position, the packer may be said to be in unset position 24 when the seal assembly, and the unidirectional and bidirectional slips are positioned such that the packer 10 may be moved in the well 15 without damaging the packer 10. Once in unset position 24, isolation apparatus 10 can be pulled upwardly or moved downwardly in well 15 and can be reset simply by slight upward movement and rotation so that lugs 268 are again disengaged from J-slot 280. Mandrel 44 may be moved downwardly so that unidirectional slip assembly 250, bidirectional slip assembly 110 and sealing elements 80, 82 and 84 each engage the casing 25. Isolation apparatus 10 can be set and unset in this manner as many times as is desired. Thus, the present invention provides a resettable packer that can be utilized in high temperature, high pressure environments.

As can be realized form the above description, the pre-set mechanism is designed to prevent premature setting of the isolation apparatus 10. Since pre-set mechanism 190 prevents the bi-directional slip assembly 110 for setting until after unidirectional slip assembly 250, bidirectional slip assembly will not prematurely set when the tool encounters wellbore restrictions or debris. Similarly, pre-set mechanism 290 prevents unidirectional slip assembly 260 from prematurely setting.

In accordance with the above description, various embodiments will now be described. In a first embodiment there is provided a downhole tool having a bi-directional slip configured to engage a casing in a subterranean well. The bi-directional slip comprises a slip frame and at least two slip banks. The slip frame has a center ring and a plurality of slats extending longitudinally uphole and downhole from the center ring and spaced radially about the center ring so as to define at least two pairs of slots. Each pair of slots has a first slot extending longitudinally uphole from the center ring and a second slot extending longitudinally downhole from the center ring. Each slip bank has a first gripping bank, a second gripping bank and a groove between the first gripping bank and second gripping bank. The first gripping bank and second gripping bank each have an outer surface configured to grip the casing. Each pair of slots is associated with one of the slip banks so that the first gripping bank is slideably received in the first slot and the second gripping bank is slideably received in the second slot. The slip bank has a set position in which the groove receives a portion of the center ring and the first gripping bank and second gripping bank extend radially outward from the slip frame so as to be able to engage the casing. The slip bank has an unset position in which the slip bank is positioned radially inward from the set position.

The bi-directional slip can further comprise a spring associated with each slip bank. The spring can be positioned between the center ring and the associated slip bank such that the spring biases the associated slip bank to the unset position. Additionally, the outer surface of each gripping bank can comprise gripping elements having gripping edges wherein the gripping edges are aligned with the radial axis of the slip. The gripping elements can be a series of wickers with each wicker aligned with the radial axis of the slip. The slip banks can be comprised of a carburized grade of steel.

Each slat of the slip frame can have an uphole end and a downhole end. Each slat can be connected to the center ring at a position between the uphole end and the downhole end. Also, the slip frame can further comprise an uphole ring connected to the uphole ends of the slats and a downhole ring connected to the downhole ends of the slats.

The downhole can further comprise a first wedge and a second wedge. The first wedge can be associated with the first gripping bank and the second wedge can be associated with the second gripping bank. The first and second wedges can be engageable with the bi-directional slip to urge each slip bank radially outward in response to a first load applied thereto so that the slip bank moves to its set position. Further, the downhole tool can comprise a mandrel with the bi-directional slip, first wedge and second wedge being disposed about the mandrel.

In some embodiments, the downhole tool can comprise a pre-set mechanism having a detent ring located between the second wedge and the mandrel and positioned at least partially in a groove in the mandrel, wherein the detent ring prevents movement of the second wedge relative to the mandrel in at least one longitudinal direction until a predetermined force is exceeded by a load on the mandrel.

In some embodiments, the downhole tool can comprise an unidirectional slip disposed about the mandrel having an expanded position in which it can engage and grip the casing and an unexpanded position in which it does not engage and grip the casing, wherein in the expanded position, the expandable slip provides sufficient anchor for the first load to move the bi-directional slip to the set position. The downhole tool can include a drag block assembly disposed about the mandrel and engaging the casing such that the drag block provides sufficient anchor that a second load applied to the mandrel to move the unidirectional slip to the expanded position, wherein the first load is greater than the second load. Also, the downhole tool can include a third wedge associated with the unidirectional slip for urging the unidirectional slip outwardly to engage the casing.

In some embodiments, the downhole tool includes a first and second pre-set mechanism. The first pre-set mechanism having a first detent ring located between the second wedge and the mandrel and positioned, at least partially, in a first groove in the mandrel. The first detent ring prevents movement of the second wedge relative to the mandrel in at least one longitudinal direction until a first predetermined force is exceeded by a load on the mandrel. The second pre-set mechanism having a second detent ring located between the third wedge and the unidirectional slip and positioned, at least partially, in a second groove in the third wedge, wherein the second detent ring prevents movement of the unidirectional slip relative to the third wedge in at least one longitudinal direction until a second predetermined force is exceeded by the load on the mandrel.

In other embodiments, there is provided a downhole tool for use in a subterranean well having a casing therein. The down hole tool comprises a mandrel, a unidirectional slip assembly, a bidirectional slip assembly and a pre-set mechanism. The unidirectional slip assembly has a first wedge and a first slip bank. The first wedge is disposed about the mandrel. The first wedge has a first end and second end. The first slip bank is associated with the first wedge such that the first wedge and first slip bank can undergo relative axial movement so as to have an unset position and a set position. In the unset position, the first slip bank is in a radially inward position and does not engage the casing. In the set position, the first slip bank is in a radially outward position and does engage the casing.

The bidirectional slip assembly has a pair of wedges and a second slip bank. The pair of wedges comprising two axially spaced wedges disposed about the mandrel and in sliding relationship with the mandrel such that the pair of wedges can slide between an unset position and a set position. The pair of wedges having a first end and a second end. The second end is operably connected to the first end of the first wedge. The second slip bank is associated with the pair of wedges such that, when the pair of wedges is in the unset position, the second slip bank is in a radially inward position and does not engage the casing, and when the pair of wedges is in the set position, the second slip bank is in a radially outward position and engages the casing.

The pre-set mechanism has a detent ring positioned at least partially in a groove extending circumferentially around the mandrel and located axially along the mandrel between the first end of the pair of slip wedges and the second end of the first wedge. The detent ring prevents either the first wedge or the pair of slip wedges from moving from the unset position to the set position until a first predetermined force is exceeded by a load on the mandrel.

In still other embodiments, there is provided a downhole tool for use in a subterranean well having a casing therein. The downhole tool comprises a mandrel, a wedge, a slip bank and a pre-set mechanism. The wedge is disposed about the mandrel and in sliding relationship with the mandrel such that the wedge can slide between an unset position and a set position. The slip bank is associated with the wedge such, when the wedge is in the unset position, the slip bank is in a radially inward position and does not engage the casing, and when the wedge is in the set position, the slip bank is in a radially outward position and engages the casing. The pre-set mechanism has a detent ring located between the wedge and the mandrel and positioned at least partially in a groove in the mandrel. The detent ring prevents the wedge from moving from the unset position to the set position until a load on the mandrel exceeds a first predetermined force.

In some of the above embodiments, the detent ring has a tubular shape, an outer surface, an inner surface, a first edge, a second edge, a first end and a second end. The first end and second end define a slot such that the detent ring has a relaxed state with a first inner diameter and a first slot width and a compressed state with a second inner diameter and a second slot width. The first inner diameter is larger than the second inner diameter and the first slot width is larger than the second slot width. The outer surface and the first edge meet at a lead angle. Further, the mandrel can have an outer wall with a groove having a bore depth. The detent ring is positioned in the groove such that the detent ring and mandrel have a coaxial alignment and the outer surface extends above the outer wall when the detent ring is in the relaxed state and the bore depth is large enough so that the detent ring can be compressed into the compressed state. The wedge or pair of wedges can have a coaxial alignment with the mandrel and can have an inner wall, wherein the inner wall has a first portion having a first inner diameter and a second portion having a second diameter smaller than the first diameter such that an angular shoulder is formed between the first portion and second portion. The wedge (or pair of wedges) and the mandrel are in sliding relation relative to each other in an axial direction and the inner wall interfaces with the outer wall of the mandrel such that, when the detent ring is in its relaxed state, the lead angle interacts with the angular shoulder so as to prevent the sleeve sliding relative to the tubular component in the axial direction until the predetermined force is exceeded.

In some of the above embodiments, when a load exceeding the predetermined force is applied to the downhole tool, the detent ring moves to the compressed state by interaction of the lead angle with the angular shoulder, and the wedge or pair of wedges slide axially relative to the mandrel so as to place the second portion of the inner wall over the detent ring. Also, when the load is subsequently reduced below the predetermined force, the wedge or pair of wedges slide axially relative to the mandrel so as to place the first portion of the inner wall over the detent ring such that the detent ring moves to the relaxed state.

In further embodiments, there is provided a downhole tool for use in a subterranean well. The downhole tool comprises a detent ring, a tubular component, and a sleeve. The detent ring has a tubular shape, an outer surface, an inner surface, a first edge, a second edge, a first end and a second end. The first end and second end define a slot such that the detent ring has a relaxed state with a first inner diameter and a first slot width, and a compressed state with a second inner diameter and a second slot width. The first inner diameter is larger than the second inner diameter, and the first slot width is larger than the second slot width. The outer surface and the first edge meet at a lead angle. The tubular component has an outer wall with a groove having a bore depth. The detent ring is positioned in the groove such that the detent ring and tubular component have a coaxial alignment and the outer surface extends above the outer wall when the detent ring is in the relaxed state and the bore depth is large enough so that the detent ring can be compressed into the compressed state. The sleeve has a coaxial alignment with the tubular component and having an inner wall. The inner wall has a first portion having a first inner diameter and a second portion having a second diameter smaller than the first diameter such that an angular shoulder is formed between the first portion and second portion. The sleeve and tubular component are in sliding relation relative to each other in an axial direction and the inner wall interfaces with the outer wall of the tubular component such that, when the detent ring is in its relaxed state, the lead angle interacts with the angular shoulder so as to prevent the sleeve sliding relative to the tubular component in the axial direction until a first predetermined force is applied to the downhole tool.

In some embodiments, when a load exceeding the first predetermined force is applied to the downhole tool, the detent ring moves to the compressed state by interaction of the lead angle with the angular shoulder, and the sleeve slides axially relative to the tubular member so as to place the second portion of the inner wall over the detent ring. Also, the load is subsequently reduced below the first predetermined force, the sleeve slides axially relative to the tubular member so as to place the first portion of the inner wall over the detent ring such that the detent ring moves to the relaxed state.

In some embodiments, the tubular component is a slip wedge and the sleeve is an expandable slip. The slip wedge is operably associated with the expandable slip such that axial movement of the slip wedge relative to the expandable slip moves the expandable slip from an unset position to a set position.

In other embodiments, the tubular component is a mandrel and the sleeve is a slip wedge disposed about the mandrel. The downhole tool further comprises an expandable slip disposed about the mandrel wherein the slip wedge is operably associated with the expandable slip such that axial movement of the slip wedge relative to the expandable slip moves the expandable slip from an unset position to a set position. The expandable slip can comprise a slip frame and at least two slip banks. The slip frame having a center ring and a plurality of slats extending longitudinally uphole and downhole from the center ring and spaced radially about the center ring so as to define at least two pairs of slots. Each pair of slots has a first slot extending longitudinally uphole from the center ring and a second slot extending longitudinally downhole from the center ring. Each slip bank has a first gripping bank, a second gripping bank and a groove between the first gripping bank and second gripping bank. The first gripping bank and second gripping bank each have an outer surface configured to grip the casing. The first gripping bank is slideably received in the first slot and the second gripping bank is slideably received in the second slot such that the slip bank has a set position in which the groove receives a portion of the center ring and the first gripping bank and second gripping bank extend radially outward from the slip frame so as to be able to engage a casing in the well, and the slip bank has an unset position in which the slip bank is positioned radially inward from the set position.

Further, each slat can have an uphole end and a downhole end and is connected to the center ring at a position between the uphole end and the downhole end. The slip frame can further comprise an uphole ring connected to the uphole ends of the slats and a downhole ring connected to the downhole ends of the slats.

Still other embodiments provide for a method of setting a downhole tool in a casing. The method comprising:

lowering the downhole tool in an unset position into a casing in a wellbore, wherein the downhole tool has a first detent ring positioned in a first groove in a tubular component, and a sleeve having a first angular shoulder formed on an inner wall of the sleeve at the junction of a first portion of the inner wall having a first inner diameter and a second portion of the inner wall having a second inner diameter less than the first inner diameter;

applying a first setting load to the downhole tool such that a first predetermined force is exceeded so as to move a first detent ring from a relaxed state to a compressed state by interaction of a lead angle on the first detent ring with the first angular shoulder, wherein the movement of the first detent ring to the compressed state allows the sleeve to slide axially relative to a tubular component; and sliding the sleeve axially relative to the tubular component so as to place the second portion of the inner wall over the first detent ring thus placing the downhole tool in a first set position, wherein the downhole tool is resettable such that the downhole tool can be moved between the first set position and the unset position multiple times.

The method can further comprise moving the downhole tool from the first set position to the unset position by sliding the sleeve axially relative to the tubular member so as to place the first portion of the inner wall over the first detent ring such that the first detent ring moves to the relaxed position and the lead angle and the first angular shoulder are in opposition so as to prevent movement of the tool to the first set position unless the first setting load is applied.

In the method, the first groove can have a bore depth, and the first detent ring can be positioned in the first groove such that the first detent ring and tubular component have a coaxial alignment and an outer surface of the detent ring extends above an outer wall of the tubular component when the detent ring is in the relaxed state. The bore depth is large enough so that the detent ring can be compressed into the bore in the compressed state.

Also in the method, the tubular component can be a first slip wedge and the sleeve can be a first expandable slip. The first slip wedge is operably associated with the first expandable slip such that axial movement of the first expandable slip relative to the first slip wedge moves the first expandable slip between a first position where the first expandable slip does not engage the casing and a second position where the first expandable slip engages the casing.

In some embodiments of the method, the downhole tool has a second detent ring positioned in a second groove in a mandrel, and a second slip wedge having a second angular shoulder formed on an inner surface of the second slip wedge at the junction of a first portion of the inner surface having a first inner diameter and a second portion of the inner surface having a second inner diameter less than the first inner diameter. After moving the downhole tool to the first set position, the method further comprises:

applying a second setting load to the downhole tool such that a second predetermined force is exceeded so as to move a second detent ring from a relaxed state to a compressed state by interaction of a lead angle on the second detent ring with the second angular shoulder on the second slip wedge, wherein the movement of the second detent ring to the compressed state allows the second slip wedge to slide axially relative to the mandrel and relative to a second expandable slip, wherein the second slip wedge is operably associated with the second expandable slip such that axial movement of the second slip wedge relative to the second expandable slip moves the second expandable slip between a first position where the second expandable slip does not engage the casing and a second position where the second expandable slip engages the casing; and sliding the second slip wedge axially relative to the mandrel and the second expandable slip so as to place the second portion of the inner wall over the first detent ring thus placing the downhole tool in a second set position, wherein the downhole tool is resettable such that the downhole tool can be moved between the second set position and the unset position multiple times.

The method can further comprise moving the downhole tool from the second set position to the unset position by:

sliding the second slip wedge axially relative to the mandrel so as to place the first portion of the inner side over the second detent ring such that the second detent ring moves to the relaxed position and the lead angle of the second detent ring and the second angular shoulder are in opposition so as to prevent movement of the tool to the second set position unless the second setting load is applied; and sliding the first expandable slip axially relative to the first slip wedge so as to place the first portion of the inner wall over the first detent ring such that the first detent ring moves to the relaxed position and the lead angle of the first detent ring and the first angular shoulder are in opposition so as to prevent movement of the tool to the first set position unless the first setting load is applied.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A downhole tool for use in a subterranean well having a casing therein, the downhole tool comprising:

a mandrel;

a unidirectional slip assembly having:

a first wedge disposed about the mandrel, the first wedge having a first end and second end; and a first slip bank associated with the first wedge such that the first wedge and first slip bank can undergo relative axial movement so as to have an unset position in which the first slip bank is in a radially inward position and does not engage the casing, and a set position in which the first slip bank is in a radially outward position and does engage the casing;

a bidirectional slip assembly having:

a pair of wedges comprising two axially spaced wedges disposed about the mandrel and in sliding relationship with the mandrel such that the pair of wedges can slide between an unset position and a set position, the pair of wedges having a first end and a second end, wherein the second end is operably connected to the first end of the first wedge; and a second slip bank associated with the pair of wedges such that, when the pair of wedges is in the unset position, the second slip bank is in a radially inward position and does not engage the casing, and when the pair of wedges is in the set position, the second slip bank is in a radially outward position and engages the casing; and a pre-set mechanism having a detent ring positioned at least partially in a groove extending circumferentially around the mandrel and located axially along the mandrel between the first end of the pair of wedges and the second end of the first wedge, wherein the detent ring prevents either the first wedge or the pair of wedges from moving from the unset position to the set position until a first predetermined force is exceeded by a load on the mandrel.

2. The downhole tool of claim 1, wherein:

the detent ring has a tubular shape, an outer surface, an inner surface, a first edge, a second edge, a first end and a second end, wherein the first end and second end define a slot such that the detent ring has a relaxed state with a first inner diameter and a first slot width and a compressed state with a second inner diameter and a second slot width and wherein the first inner diameter is larger than the second inner diameter and the first slot width is larger than the second slot width, and wherein the outer surface and the first edge meet at a lead angle.

3. The downhole tool of claim 2, wherein:

the mandrel has an outer wall with the groove and the groove has a bore depth, wherein the detent ring is positioned in the groove such that the detent ring and mandrel have a coaxial alignment and the outer surface extends above the outer wall when the detent ring is in the relaxed state and the bore depth is large enough so that the detent ring can be compressed into the compressed state.

4. The downhole tool of claim 3, wherein:

the pair of wedges have an inner wall, wherein the inner wall has a first portion having a first inner diameter and a second portion having a second inner diameter smaller than the first inner diameter such that an angular shoulder is formed between the first portion and second portion;

the detent ring is located between the inner wall and the mandrel;

the pair of wedges have a coaxial alignment with the mandrel;

the pair of wedges and the mandrel are in sliding relation relative to each other in an axial direction; and the inner wall interfaces with the outer wall of the mandrel such that, when the detent ring is in its relaxed state, the lead angle interacts with the angular shoulder so as to prevent the sleeve sliding relative to the tubular component in the axial direction until the predetermined force is exceeded.

5. The downhole tool of claim 4, wherein:

when a load exceeding the predetermined force is applied to the downhole tool, the detent ring moves to the compressed state by interaction of the lead angle with the angular shoulder, and the pair of wedges slides axially relative to the mandrel so as to place the second portion of the inner wall over the detent ring.

6. The downhole tool of claim 5, wherein:

when the load is subsequently reduced below the predetermined force, the pair of wedges slides axially relative to the mandrel so as to place the first portion of the inner wall over the detent ring such that the detent ring moves to the relaxed state.

7. A downhole tool for use in a subterranean well, the downhole tool comprising:

a detent ring having a tubular shape, an outer surface, an inner surface, a first edge, a second edge, a first end and a second end, wherein the first end and second end define a slot such that the detent ring has a relaxed state with a first inner diameter and a first slot width, and a compressed state with a second inner diameter and a second slot width, and wherein the first inner diameter is larger than the second inner diameter and the first slot width is larger than the second slot width, and wherein the outer surface and the first edge meet at a lead angle;

a tubular component having an outer wall with a groove having a bore depth, wherein the detent ring is positioned in the groove such that the detent ring and tubular component have a coaxial alignment and the outer surface extends above the outer wall when the detent ring is in the relaxed state and the bore depth is large enough so that the detent ring can be compressed into the compressed state; and a sleeve having a coaxial alignment with the tubular component and having an inner wall, wherein the inner wall has a first portion having a first inner diameter and a second portion having a second inner diameter smaller than the first inner diameter such that an angular shoulder is formed between the first portion and second portion, wherein the sleeve and tubular component are in sliding relation relative to each other in an axial direction and the inner wall interfaces with the outer wall of the tubular component such that, when the detent ring is in its relaxed state, the lead angle interacts with the angular shoulder so as to prevent the sleeve sliding relative to the tubular component in the axial direction until a first predetermined force is applied to the downhole tool.

8. The downhole tool of claim 7, wherein:

when a load exceeding the first predetermined force is applied to the downhole tool, the detent ring moves to the compressed state by interaction of the lead angle with the angular shoulder, and the sleeve slides axially relative to the tubular member so as to place the second portion of the inner wall over the detent ring.

9. The downhole tool of claim 8, wherein:

when the load is subsequently reduced below the first predetermined force, the sleeve slides axially relative to the tubular member so as to place the first portion of the inner wall over the detent ring such that the detent ring moves to the relaxed state.

10. The downhole tool of claim 7, wherein the tubular component is a slip wedge and the sleeve is an expandable slip, and wherein the slip wedge is operably associated with the expandable slip such that axial movement of the slip wedge relative to the expandable slip moves the expandable slip from an unset position to a set position.

11. The downhole tool of claim 7, wherein:

the tubular component is a mandrel and the sleeve is a slip wedge disposed about the mandrel: and the downhole tool further comprises an expandable slip disposed about the mandrel wherein the slip wedge is operably associated with the expandable slip such that axial movement of the slip wedge relative to the expandable slip moves the expandable slip from an unset position to a set position.

12. The downhole tool of claim 11, wherein the subterranean well has a casing and the expandable slip comprises:

a slip frame having a center ring and a plurality of slats extending longitudinally uphole and downhole from the center ring and spaced radially about the center ring so as to define at least two pairs of slots, wherein each pair of slots has a first slot extending longitudinally uphole from the center ring and a second slot extending longitudinally downhole from the center ring; and at least two slip banks, wherein each slip bank has a first gripping bank, a second gripping bank and a groove between the first gripping bank and second gripping bank, wherein the first gripping bank and second gripping bank each have an outer surface configured to grip the casing, and wherein the first gripping bank is slideably received in the first slot and the second gripping bank is slideably received in the second slot such that the slip bank has a set position in which the groove receives a portion of the center ring and the first gripping bank and second gripping bank extend radially outward from the slip frame so as to be able to engage the casing, and the slip bank has an unset position in which the slip bank is positioned radially inward from the set position.

13. The downhole tool of claim 12, wherein each slat has an uphole end and a downhole end and is connected to the center ring at a position between the uphole end and the downhole end, and the slip frame further comprises:

an uphole ring connected to the uphole ends of the slats; and a downhole ring connected to the downhole ends of the slats.

14. The downhole tool of claim 13, wherein:

when a load exceeding the first predetermined force is applied to the downhole tool, the detent ring moves to the compressed state by interaction of the lead angle with the angular shoulder, and the slip wedge slides axially relative to the tubular member and relative to the expandable slip so as to place the second portion of the inner wall over the detent ring and so as to move the expandable slip into the set position, and when the load is subsequently reduced below the first predetermined force, the slip wedge slides axially relative to the tubular member and relative to the expandable slip so as to place the first portion of the inner wall over the detent ring such that the detent ring moves to the relaxed state and so as to move the expandable slip into the unset position.

15. A method of setting a downhole tool in a casing comprising:

lowering the downhole tool in an unset position into the casing in a wellbore, wherein the downhole tool has a first detent ring positioned in a first groove in a tubular component, and a sleeve having a first angular shoulder formed on an inner wall of the sleeve at the junction of a first portion of the inner wall having a first inner diameter and a second portion of the inner wall having a second inner diameter less than the first inner diameter; and applying a first setting load to the downhole tool such that a first predetermined force is exceeded so as to move the first detent ring from a relaxed state to a compressed state by interaction of a lead angle on the first detent ring with the angular shoulder on the sleeve, wherein the movement of the first detent ring to the compressed state allows the sleeve to slide axially relative to the tubular component;

sliding the sleeve axially relative to the tubular component so as to place the second portion of the inner wall over the first detent ring thus placing the downhole tool in a first set position, wherein the downhole tool is resettable such that the downhole tool can be moved between the first set position and the unset position multiple times.

16. The method of claim 15, further comprising:

moving the downhole tool from the first set position to the unset position by sliding the sleeve axially relative to the tubular member so as to place the first portion of the inner wall over the first detent ring such that the first detent ring moves to the relaxed position and the lead angle and the first angular shoulder are in opposition so as to prevent movement of the tool to the first set position unless the first setting load is applied.

17. The method of claim 16, wherein the first groove has a bore depth, and the first detent ring is positioned in the first groove such that the first detent ring and tubular component have a coaxial alignment and an outer surface of the detent ring extends above an outer wall of the tubular component when the detent ring is in the relaxed state, and the bore depth is large enough so that the detent ring can be compressed into the groove in the compressed state.

18. The method of claim 17, wherein:

the tubular component is a first slip wedge;

the sleeve is a first expandable slip; and the first slip wedge is operably associated with the first expandable slip such that axial movement of the first expandable slip relative to the first slip wedge moves the first expandable slip between a first position where the first expandable slip does not engage the casing and a second position where the first expandable slip engages the casing.

19. The method of claim 18, wherein:

the downhole tool has a second detent ring positioned in a second groove in a mandrel, and a second slip wedge having a second angular shoulder formed on an inner surface of the second slip wedge at the junction of a first portion of the inner surface having a first inner diameter and a second portion of the inner surface having a second inner diameter less than the first inner diameter; and after moving the downhole tool to the first set position, the method further comprises:

applying a second setting load to the downhole tool such that a second predetermined force is exceeded so as to move the second detent ring from a relaxed state to a compressed state by interaction of a lead angle on the second detent ring with the second angular shoulder on the second slip wedge, wherein the movement of the second detent ring to the compressed state allows the second slip wedge to slide axially relative to the mandrel and relative to a second expandable slip, wherein the second slip wedge is operably associated with the second expandable slip such that axial movement of the second slip wedge relative to the second expandable slip moves the second expandable slip between a first position where the second expandable slip does not engage the casing and a second position where the second expandable slip engages the casing; and sliding the second slip wedge axially relative to the mandrel and the second expandable slip so as to place the second portion of the inner wall over the second detent ring thus placing the downhole tool in a second set position, wherein the downhole tool is resettable such that the downhole tool can be moved between the second set position and the unset position multiple times.

20. The method of claim 19, further comprising moving the downhole tool from the second set position to the unset position by:

sliding the second slip wedge axially relative to the mandrel so as to place the first portion of the inner side over the second detent ring such that the second detent ring moves to the relaxed position and the lead angle of the second detent ring and the second angular shoulder are in opposition so as to prevent movement of the tool to the second set position unless the second setting load is applied; and sliding the first expandable slip axially relative to the first slip wedge so as to place the first portion of the inner wall over the first detent ring such that the first detent ring moves to the relaxed position and the lead angle of the first detent ring and the first angular shoulder are in opposition so as to prevent movement of the tool to the first set position unless the first setting load is applied.

* * * * *